US007175813B2

(12) United States Patent
Petrek et al.

(10) Patent No.: US 7,175,813 B2
(45) Date of Patent: Feb. 13, 2007

(54) VOLUME ADJUSTABLE MANUAL PIPETTE WITH QUICK SET VOLUME ADJUSTMENT

(75) Inventors: James S. Petrek, Danville, CA (US); Phillip Yee, San Francisco, CA (US); Kenneth Rainin, Piedmont, CA (US)

(73) Assignee: Rainin Instrument, LLC, Oakland, CA (US)

( * ) Notice: Subject to any disclaimer, the term of this patent is extended or adjusted under 35 U.S.C. 154(b) by 68 days.

(21) Appl. No.: 10/751,203

(22) Filed: Dec. 31, 2003

(65) Prior Publication Data

US 2005/0142038 A1 Jun. 30, 2005

(51) Int. Cl.
*B01L 3/02* (2006.01)

(52) U.S. Cl. ..... 422/100; 73/864.14; 73/864.18

(58) Field of Classification Search ..... 422/100; 73/864.14, 864.18
See application file for complete search history.

(56) References Cited

U.S. PATENT DOCUMENTS 3,766,784 A * 10/1973 Walker ..... 73/864.18
3,853,012 A * 12/1974 Scordato et al. ..... 73/864.14
4,020,698 A * 5/1977 D'Autry ..... 73/864.18
4,096,751 A * 6/1978 Withers et al. ..... 73/864.18
4,466,298 A * 8/1984 Tervamaki et al. ..... 73/864.18
4,909,991 A * 3/1990 Oshikubo ..... 422/100
5,012,682 A * 5/1991 Sabloewski ..... 73/864.18
5,018,394 A * 5/1991 Gilson ..... 73/864.18
5,413,006 A * 5/1995 D'Autry ..... 73/864.18
6,428,750 B1 * 8/2002 Rainin et al. ..... 422/100
2002/0041833 A1 * 4/2002 Telimaa et al. ..... 422/100

* cited by examiner

*Primary Examiner*—Brian R. Gordon
(74) *Attorney, Agent, or Firm*—Robert R. Meads

(57) ABSTRACT

A volume adjustable pipette, comprising a plunger mounted for movement in a housing to and from a stop to aspirate a fluid into and dispense the fluid from a tip extending from the housing. An axially moveable volume setting member in the housing defines the stop and a volume setting for the pipette and is axially moveable by a user turnable volume setting member. Turning of the volume adjusting member also controls a coarse volume setting means and a fine volume setting means, the course volume setting means being responsive to a relatively small turning of the volume adjusting member for moving the volume setting member a relatively large axial distance and the fine volume setting means being responsive to a relatively large turning of the volume adjusting member for moving the volume setting member a relatively small axial distance.

12 Claims, 16 Drawing Sheets

VOLUME ADJUSTABLE MANUAL PIPETTE WITH QUICK SET VOLUME ADJUSTMENT

BACKGROUND

The present invention relates to volume adjustable manual pipettes and, more particularly, to an improved manual pipette including a quickly settable volume adjustment mechanism.

U.S. Pat. No. 3,827,305 describes one of the earliest commercially available digitally adjustable air displacement pipettes. To provide for volume adjustment, the pipette includes a threaded shaft extending through a fixed nut. Manual turning of the shaft produces axial movement of a stop member for limiting axial movement of a plunger to define a volume setting for the pipette. The volume setting is displayed on a mechanical micrometer display comprising a series of indicator rings each encircling the threaded shaft.

U.S. Pat. No. 4,909,991 describes a later commercially available single channel manual pipette manufactured by Nichiryo Co. Ltd., Tokyo, Japan. The Nichiryo pipette includes an elongated hand-holdable housing for an upwardly spring biased plunger. An upper end of the plunger extends above a top of the housing and carries a control knob for thumb and finger engagement in manually turning the plunger and for axially moving the plunger in the pipette housing between an upper stop and a lower stop at which all liquid within a tip secured to a lower end of the housing is expelled by the downward movement of the plunger. The upper stop is axially adjustable within the housing in response to a turning of a hollow volume adjustment screw or shaft keyed to the plunger. The axial adjustment of the upper stop adjusts the volume of liquid that the pipette is capable of drawing into the tip in response to upward movement of the plunger to the upper stop. The pipette also includes a lock mechanism including a lock knob for locking the plunger against rotation to thereby set the upper stop in a fixed position and hence set the volume adjustment for the pipette.

Volume adjustable manual pipettes with electronic digital displays have also been developed and are disclosed in U.S. Pat. Nos. 4,567,780; 4,763,535; and 5,892,161.

For a more complete understanding of the current state of the art relative to the volume adjustability of manual pipettes, each of the above-identified patents is incorporated by reference into this application.

In each of the foregoing prior manual pipettes, volume setting requires the repeated turning of either the threaded volume setting shaft or the turning of the displacement plunger of the pipette while viewing the volume display of the pipette. Where successive volume setting for a pipette are of values of considerable difference, appreciable time and physical effort are required to accomplish the volume settings.

Thus, one of the shortcomings of prior manual pipettes is the time, physical effort and care required to accurately manually set the volume of such pipettes. In an attempt to reduce the time required to change the volume settings of a manual pipette, the Socorex Micropipette Calibra 822 includes a volume setting mechanism including two cylindrical cams. A larger one of the cams shows numbers on a left side of a window of a mechanical volume display for the pipette while a smaller one of the cams shows numbers on a right side of the window. After locking of a plunger-button of the pipette, a turning of a setting wheel turns the larger cam to change the numbers displayed thereby. Then a pulling out of the setting wheel followed by a turning thereof produces a turning of the smaller cam and numbers displayed thereby. Such turning of the cams sets mechanical stops within the pipette to control the volume of liquid, which the pipette will aspirate and dispense. While the volume setting structure of the Calibra pipette may reduce the time required to set the volume of a manual pipette, the volume setting structure is relatively complex and costly when compared to conventional manual pipette volume setting mechanisms as described above. Also, the volume setting provided by the Calibra pipette is not as fine a setting as is provided by conventional volume setting mechanisms.

U.S. Pat. No. 6,428,750 issued Aug. 6, 2002 to the assignee of the present invention, describes an improved volume adjustable manual pipette having a quick set volume adjustment that addresses the shortcomings of the Calibra pipette. Basically, that volume adjustable manual pipette comprises an axially elongated hand-holdable housing supporting (i) an electronic digital display and associated position sensing and control circuitry, (ii) a plunger unit and (iii) a quick set volume adjustment mechanism for simultaneously controlling the volume setting of the pipette and the electronic display. The quick set volume adjustment mechanism comprises a pipette volume setting member for limiting upward movement of the plunger unit within the housing to define the volume setting for the pipette. The volume setting member is supported for axial movement on the plunger unit and is releasably secured relative to the housing by a pipette user operable locking mechanism. When released from the housing, the volume setting member is axially moveable on and with the plunger unit to quickly set the volume for the pipette. When secured to the housing, the plunger unit is axially moveable relative to the volume setting unit to aspirate and dispense the selected volume of liquid into and from a pipette tip secured to a hollow shaft extending from a lower end of the housing. The volume setting of the pipette is monitored by the sensing and control circuitry to provide a real time display of the volume setting of the pipette on the electronic digital display. While the quick set features represented a considerable advance in the art of manual pipettes, the multiple step locking and unlocking operation limits the ease and speed of operation of the pipette.

Accordingly, there is a continuing need for a volume adjustable manual pipette including a simple volume adjustment mechanism characterized by quick and highly accurate adjustability. The present invention satisfies that need.

SUMMARY OF INVENTION

Basically, the volume adjustable pipette of the present invention comprises a plunger mounted for movement in a housing to and from a stop to aspirate a fluid into and dispense the fluid from a tip extending from the housing. An axially moveable volume setting member in the housing defines the stop and a volume setting for the pipette and is axially moveable by a user turnable volume adjusting member. Turning of the volume adjusting member also controls a coarse volume setting means and a fine volume setting means. The coarse volume setting means is responsive to a relatively small turning of the volume adjusting member for moving the volume setting member a relatively large axial distance while the fine volume setting means is responsive to a relatively large turning of the volume adjusting member for moving the volume setting member a relatively small axial distance. Thus, the present invention provides a rapid setting of the volume of a pipette simply by sequential turning of a volume adjusting member.

DETAILED DESCRIPTION OF INVENTION

Figure 1:
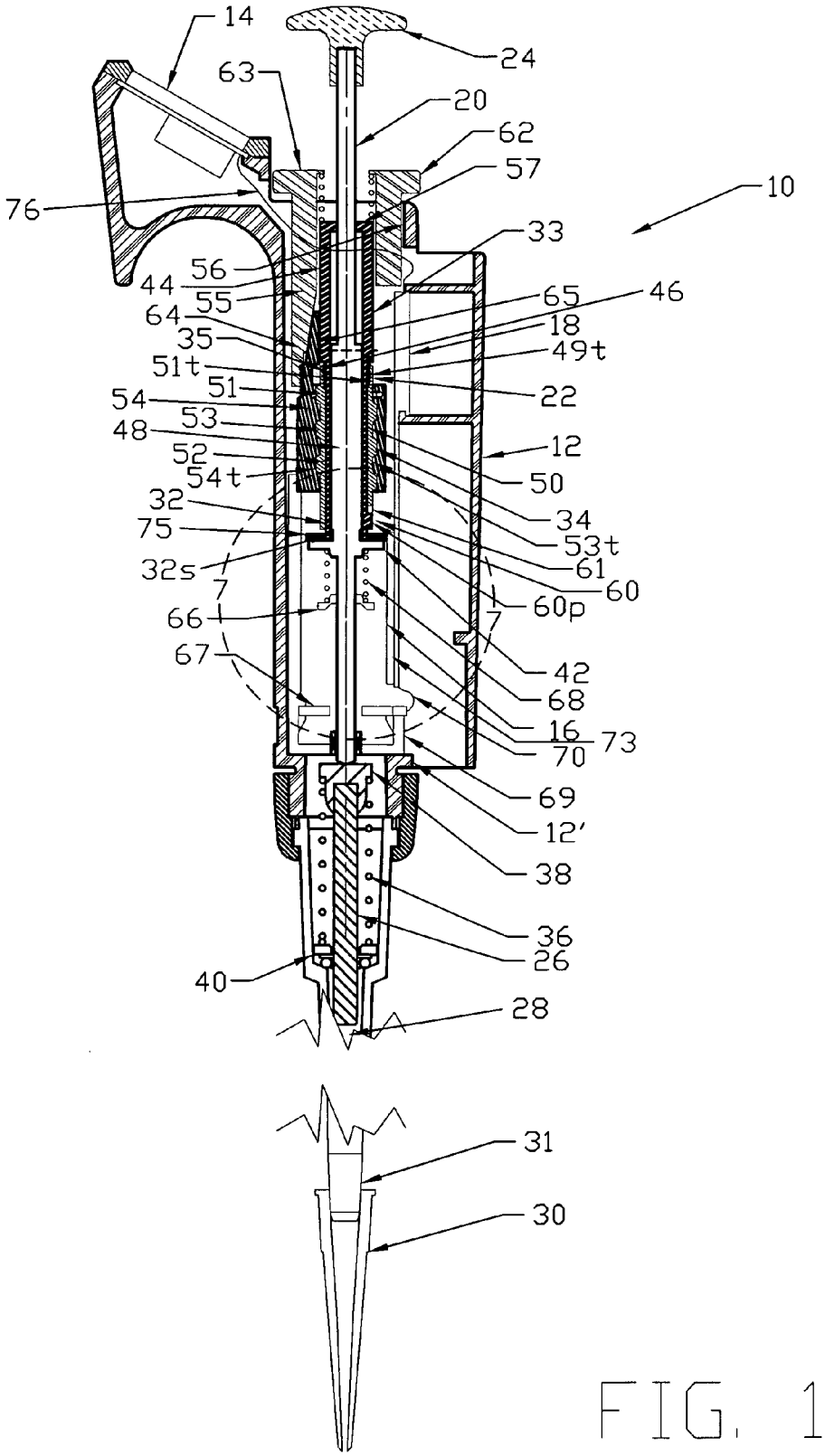
FIG. 1 is a fragmentary sectional side view of a volume adjustable manual pipette in having an axially elongated hand-holdable housing supporting an electronic digital display and associated position sensing and control circuitry, a plunger unit and a first embodiment of a quick set volume adjustment mechanism according to the present invention.

As depicted generally in the drawings, the present invention comprises a volume adjustable manual pipette 10 having an axially elongated hand-holdable housing 12 supporting (i) an electronic digital display 14 and associated position sensing circuitry 16 and control circuitry 18, (ii) a plunger unit 20 and (iii) a quick set volume adjustment mechanism 22 for simultaneously controlling the volume setting of the pipette and the electronic display.

The plunger unit 20 is upwardly spring biased and supported for axial movement within the housing 12 with an upper end supporting a control knob 24 above a top of the housing. The housing is shaped for hand gripping by a pipette user with his or her thumb free to depress the control knob 24 and move a lower end of the plunger unit carrying a piston 26 downwardly into a cylinder 28 to dispense liquid from a pipette tip 30 secured to the hollow shaft 31 extending from the lower end of the housing.

Basically, the quick set volume adjustment mechanism 22 comprises a volume setting member 32 for limiting upward axial movement of the plunger unit 20 in the housing 12 to define the volume setting for the pipette 10. In the present invention, the volume setting member 32 preferably is supported for axial movement in the housing 12 only in response to a user turning of a volume adjusting member 33. In this regard, a turning of the volume adjusting member 33 activates operation of either a coarse volume setting means 34 or a fine volume setting means 35. The coarse volume settings means 34 is supported in the housing 12 such that when activated, a relatively small turning of the volume adjusting member 33 produces a relatively large axial movement (i.e. coarse adjustment) of the volume setting member 32. Similarly, the fine volume setting means 35 is supported within the housing 12 such that when activated, a relatively large turning of the volume adjusting member 33 produces a relatively small axial movement (i.e. fine adjustment) of the volume setting member 32. Thus, by sequentially activating the coarse and fine volume setting means 34 and 35 through a sequential turning of the volume adjusting member 33, a user of the pipette of the present invention is able to quickly and accurately set and reset the volume of the pipette simply by turning the volume adjusting member. In these regards, a sequential turning of the volume adjusting member 33 is defined as a turning of the volume adjusting member which will sequentially activate the coarse and fine volume setting means 34 and 35.

More particularly as to the pipette 10 illustrated in FIG. 1, the plunger unit 20 of the pipette is upwardly spring biased by a return spring 36 compressed between a piston return 38 and a bottom spring retainer 40. The upward bias provided by the return spring 36 causes the plunger unit 20 to move upwardly within the housing 12 until a flange member 42 fixed to the plunger engages a bottom or stop surface 32*s* comprising the volume setting member 32. In these regards, and as illustrated in FIG. 1, the volume setting member 32 of the pipette 10 comprises the lower end of a sleeve 44 having a hex-shaped axial bore 46 axially receiving a hex-shaped mid-portion 48 of the plunger 20. The sleeve 44 comprises the volume adjusting member 33 having an external fine thread 49*t* on a mid-portion 50 thereof. As most clearly shown in FIGS. 6A–D, the thread 49*t* is designed to mate with an internal fine thread 51*t* on an upper end portion 51 of an axially extending tubular screw 52. The tubular screw 52 also includes a course external thread 53*t* on a mid-portion 53 thereof mating with a coarse internal thread 54*t* on a tubular coarse thread retainer 54 extending axially downward from a conventional volume lock 55 mounted within an open upper end 56 of the housing 12 of the pipette 10. As will be detailed hereinafter, in the embodiment of the present invention illustrated in FIGS. 1–6, the mating external and internal fine threads 49*t* and 51*t* comprise the fine volume setting means 35 while the mating external and internal coarse threads 53*t* and 54*t* comprise the coarse volume setting means 34 of the quick set volume adjusting mechanism 22.

Further, as shown in FIGS. 1–4, the tubular screw 52 axially receives the sleeve 44 comprising the volume adjusting member 33 such that the volume setting member 32 extends below the lower end of the screw 52 to engage the flange 42 and function as the upper stop defining the volume setting for the pipette.

Also, the sleeve 44 steps radially outward above the fine thread 49*t* and extends vertically upward within the volume lock 55 with an inwardly projecting collar 57 slidably engaging the plunger 20 below the control knob 24. Thus configured, when the volume lock 55 is released, a turning of the control knob 24 will produce a like turning of the sleeve 44. Depending on the initial rotational position of the sleeve 44 relative to the screw 52, an initial turning of the sleeve may produce a turning of the sleeve relative to the screw with the threads 49*t* riding up or down on the threads 51*t* to produce a fine adjustment of the axial position of the volume setting member 32 by operation of the fine volume setting means 35. Alternatively, an initial turning of the sleeve 44 may produce a turning of the sleeve with the screw 52 with the threads 53*t* riding up or down on the threads 54*t* to produce a coarse adjustment of the axial position of the volume setting member 32 by operation of the coarse volume setting means 34.

As indicated above, the initial rotational position of the sleeve 44 relative to the screw 52 will determine which of the coarse or fine volume setting means 34 or 35 is initially operational. In this regard, for the embodiment of the quick set volume setting mechanism 22 illustrated in FIGS. 1–4, the coarse volume setting means 34 is characterized by a force threshold for movement of the volume setting member 32. That threshold is only exceeded by a predetermined movement of the fine volume setting means 35 in response to a turning of the volume adjusting member 33. As illustrated for example in FIG. 2, a friction ring 58 is seated in an annular groove 59 in the coarse thread retainer 54 to bear against the screw 52 and prevent turning of the screw until the force threshold defined by the friction ring has been overcome. Thus, if the force threshold of the coarse volume setting means 34 is not overcome, an initial turning of the sleeve 44 (volume adjusting member 33) with the plunger unit 24 will cause the thread 49*t* to ride up or down on the thread 51*t* depending upon the direction of rotation of the volume adjusting member. This will effect a fine vertical adjustment of the volume setting member 32 and volume setting for the pipette 10, the screw 52 being held stationary by the friction ring 58. However, if the force threshold of the coarse volume setting means 34 is overcome, a turning of the volume adjusting member 33 will cause the screw 52 to turn with the volume adjusting member 33. Then, depending upon the direction of rotation of the volume adjusting member 33, coarse thread 53*t* of the coarse volume setting means 34 will ride up or down the coarse thread 54*t* on the retainer 54 to effect a coarse vertical adjustment of the volume setting member 32 and volume setting for the pipette 10.

In the embodiment of the present invention shown in FIGS. 1–4, the means for overcoming the force threshold of the coarse volume setting means 34 with a turning of the volume adjusting member 33 comprises a fine volume adjustment limiter 60 on a one of the volume adjusting member 33 or screw 52 and a shoulder 61 on another of the volume adjusting member 33 or screw 52. In FIGS. 1–4 and 5A, the fine volume adjustment limiter 60 is shown as comprising a pin 60*p* extending radially outward from the sleeve 44 of the volume adjusting member 33 adjacent a lower end thereof. The pin 60*p* rides in an arc-shaped groove 61*g* in a lower end of the tubular screw 52 with opposite ends of the groove defining the shoulder 61 and a shoulder 61'. If, for example, the pin 60*p* is in the initial rotational position "3" in FIG. 5A against the shoulder 61, upon an initial turning of the volume adjusting member 33 in a counterclockwise direction to the position "4" in FIG. 5B, as by a turning of the control knob 24, the member 33 will overcome the force threshold defined by the friction ring 58 and the screw 52 and sleeve 44 will turn together in a counterclockwise direction with the member 33 to the rotational position indicated in FIG. 5B. With such movement, the coarse thread 53*t* rides on the stationary coarse thread 54*t* to effect a coarse adjustment of the vertical position of the volume setting member 32 and its stop surface 32*s* within the housing 12 and a coarse volume setting for the pipette 10 as depicted by the upward movement of the screw 52 relative to the retainer 54 in FIG. 6D. If the pipette user then desires to more finely adjust the volume setting for the pipette 10, he or she may simply turn the volume adjusting member 33 in a clockwise direction as by a clockwise turning of the control knob 24. such movement of the volume adjusting member 33 will move the pin 60*p* away from the shoulder 61 and will cause the fine thread 49*t* to ride on the stationary fine thread 51*t* to effect a fine vertical adjustment of the volume setting member 32 and surface 32*s* within the housing 12 and a fine volume setting for the pipette.

Figure 5A:
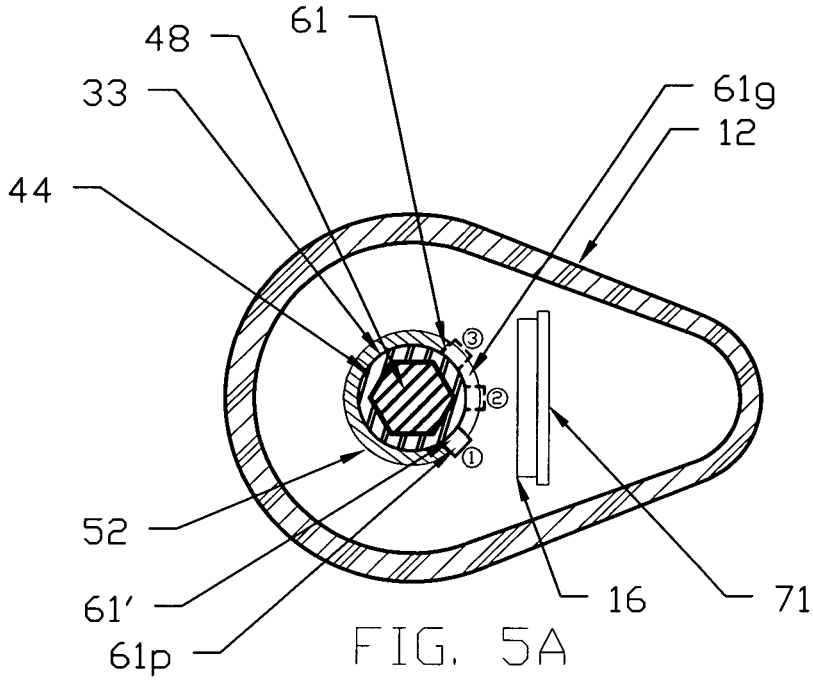
FIG. 5A is an enlarged section top view of a portion of quick set mechanism shown in FIG. 2 looking in the direction A—A and showing the volume adjusting member in different rotational positions during fine adjustment of the volume setting member.
Figure 5B:
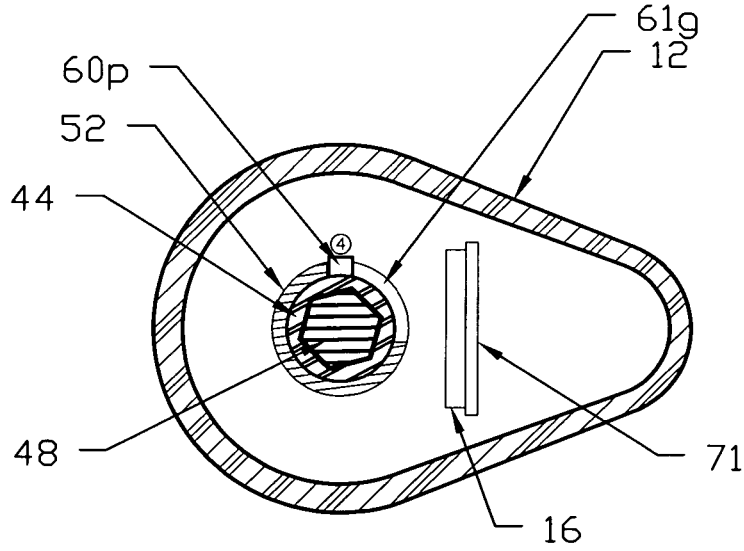
FIG. 5B is an enlarged section top view of a portion of quick set mechanism shown in FIG. 2 looking in the direction A—A and showing the volume adjusting member in rotational position during coarse adjustment of the volume setting member.

If, however, the pin 60*p* is in the initial rotational position "1" in FIG. 5A against the shoulder 61', upon an initial turning of the volume adjusting member 33 in a clockwise direction, for example to a position opposite that indicated as "4" in FIG. 5B, the member 33 will also overcome the force threshold defined by the friction ring 58 and the screw 52 and sleeve 44 will turn together in a clockwise direction with the member 33. With such movement, the coarse thread 53*t* rides on the stationary coarse thread 54*t* to effect a coarse adjustment of the vertical position of the volume setting member 32 and its stop surface 32*s* within the housing 12 and a coarse volume setting for the pipette 10. If the pipette user then desires to more finely adjust the volume setting for the pipette 10, he or she may simply turn the volume adjusting member 33 in a counterclockwise direction as by a counterclockwise turning of the control knob 24. Such movement of the volume adjusting member 33 will move the pin 60*p* away from the shoulder 61' and will cause the fine thread 49*t* to ride on the stationary fine thread 51*t* to effect a fine vertical adjustment of the volume setting member 32 and surface 32*s* within the housing 12 and a fine volume setting for the pipette.

Figure 6A:
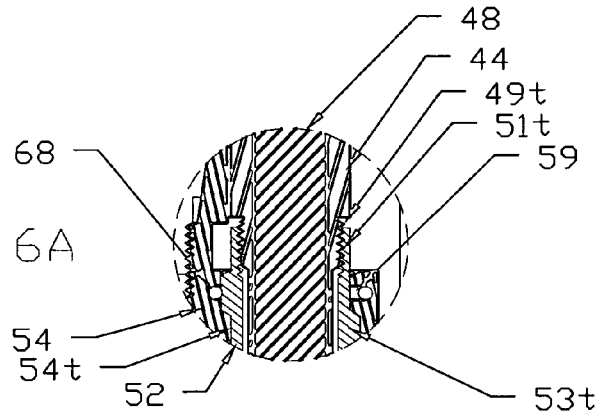
FIGS. 6A, 6B, 6C and 6D are enlarged sectional side views of a portion of quick set mechanism shown within the oval labeled 6—6 in FIG. 2 showing the vertical position of the volume adjusting member in the rotational positions depicted in FIGS. 5A and 5B.
Figure 6B:
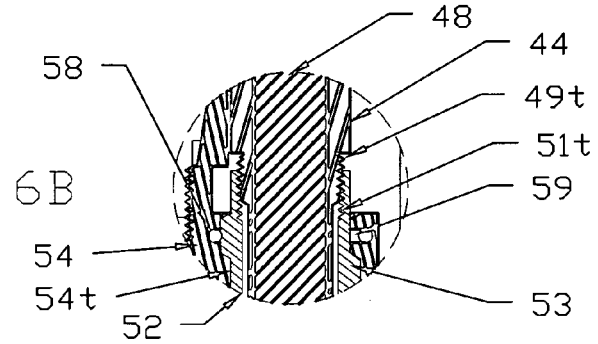
Figure 6C:
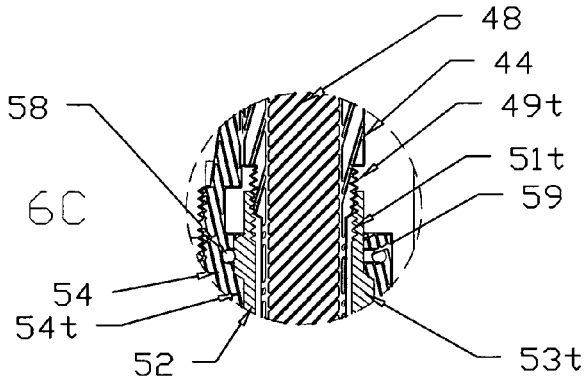
Figure 6D:
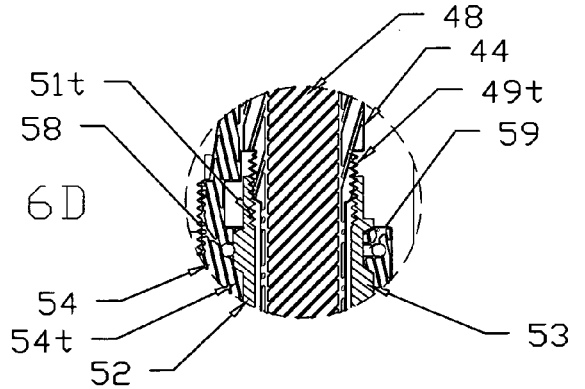
Figure 7:
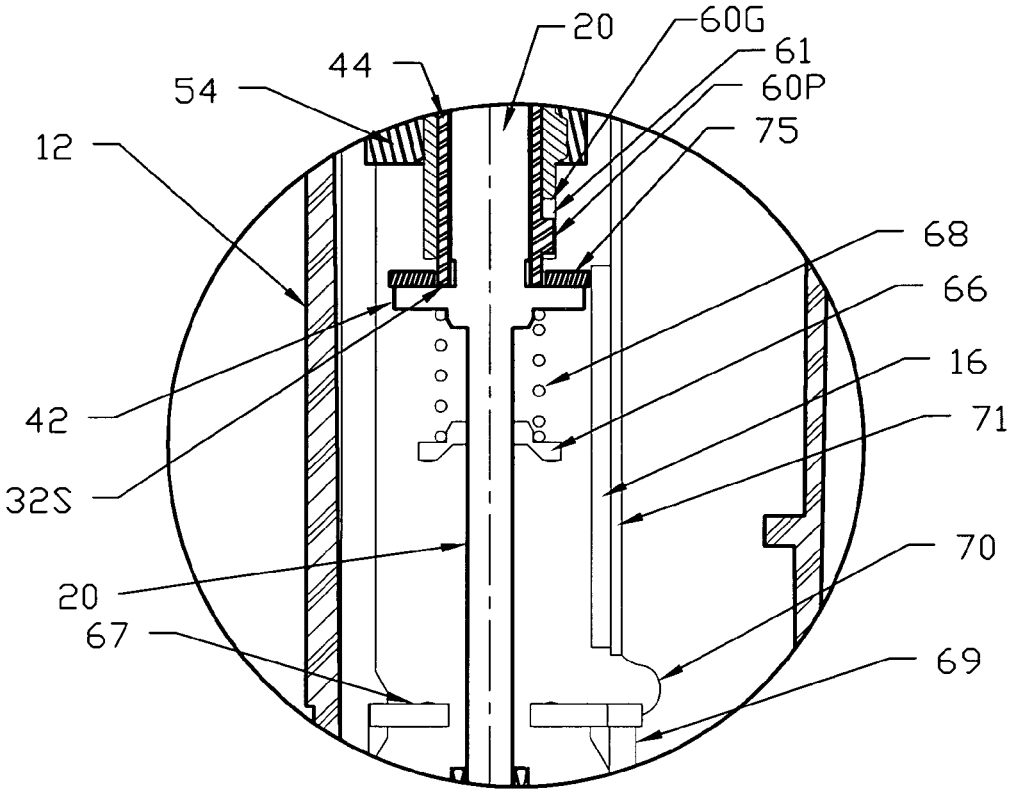
FIG. 7 is an enlarged view of the portion of FIG. 1 within the circle labeled 7—7.

Of course, if the pin 60*p* is in an initial position corresponding to position "1" or position "3" in FIG. 5A, or any position in between, e.g. position "2", and only a fine adjustment of the volume setting of the pipette 10 is desired, the user may turn the volume adjusting member 33 in the appropriate counterclockwise or clockwise directions, as by a turning of the control knob 24, and the fine thread 49*t* will ride up or down the stationary fine thread 51*t* to effect the desired fine adjustment of the volume setting member 32 and its stop surface 32*s* as represented by the showings of FIGS. 6A–C. However, if the pin 60*p* is in an initial position between position "1" and "3" as depicted in FIG. 5A, e.g. position "2", and the user desires to effect a large change in the volume setting for the pipette 10, the pin 60*p* first must be turned by the volume adjusting member 33 to position "1" or position "3" depending upon whether the volume setting is to be increased or decreased. During such turning of the pin 60*p* the fine volume setting means 35 is activated. Once the pin 60*p* reaches position "1" or "3", a continued turning of the volume adjusting member 33 and pin 60*p* in the same direction will deactivate the fine volume setting means 35 and will activate the coarse volume setting means 34 as previously described. Continued turning of the volume adjusting member 33 will produce a rapid coarse adjustment of the volume setting member 32 to the desired new volume setting or slightly beyond, whereupon the user will deactivate the coarse volume setting means 34 and activate the fine volume setting means 35 by reversing the direction of turning of the volume adjusting member 33. With activation of the fine volume setting means 35, the user will continue turning the volume adjusting member 33 to produce a fine adjustment of the volume setting member 32 to the new desired volume setting for the pipette.

In any event, once the desired volume setting of the pipette has been achieved by a turning of the volume adjusting member 33 as described above, the user may set the desired volume setting for the pipette 10. This is accomplished by the user activating the volume lock 55 to secure the volume adjusting member 33 relative to the housing 12. In this regard, the conventional volume lock 55 illustrated in the drawings may comprise a lock knob 62 extending upwardly through the open end 56 of the housing 12. The lock knob 62 is supported such that an enlarged annular upper end 63 of the lock knob is located above a top of the housing 12 just below the control knob 24. The upper end 63 is designed for finger gripping by a pipette user when it desired to turn the lock knob 62 and release or activate the lock 55. In this regard, a plurality of circumferentially spaced arc-shaped vertical prongs 64 extend downward from the lock knob 62 each with an internal thread 64*t* engaging an external thread 65*t* on corresponding circumferentially spaced arc-shaped vertical prong 65 carried by the tubular retainer 54. For increased clarity, only one of each of the plurality of prongs 64 and prongs 65 is shown in each of FIGS. 1–4. As illustrated, each prong 64 includes a downwardly and outwardly inclined cam surface 64*c* mating with an upwardly and inwardly inclined cam surface 65*c* on each prong 65. Also, an inner surface 65*i* of each prong 65 closely follows the cylindrical exterior of the radially enlarged portion of the sleeve 44 comprising the volume adjusting member 33. Thus constructed, when a pipette user desires to lock the volume setting for the pipette 10, the user simply grasps and turns the lock knob 62 in a first direction such that cooperative action of the threads 64*t* and 65*t* and cam surfaces 64*c* and 65*c* wedge the inner surfaces 65*i* against the sleeve 44 locking the volume adjusting member 33 against turning within the housing 12. When a pipette user desires to release the lock 55 and adjust the volume setting for the pipette, the user simply grasps and turns the lock knob 58 in an opposite direction. Cooperative action of the threads 64*t* and 65*t* then separates the cam surfaces 64*c* and 65*c* and releases the inner surfaces 65*i* from the sleeve 44 thereby freeing the volume adjusting member 33 for turning in the housing to quickly and accurately adjust the volume setting for the pipette in the manners previously described. Once the desired new volume setting has been achieved, the lock 55 is again activated as previously described readying the pipette 10 for operation in aspirating and dispensing sample fluids.

Figure 2:
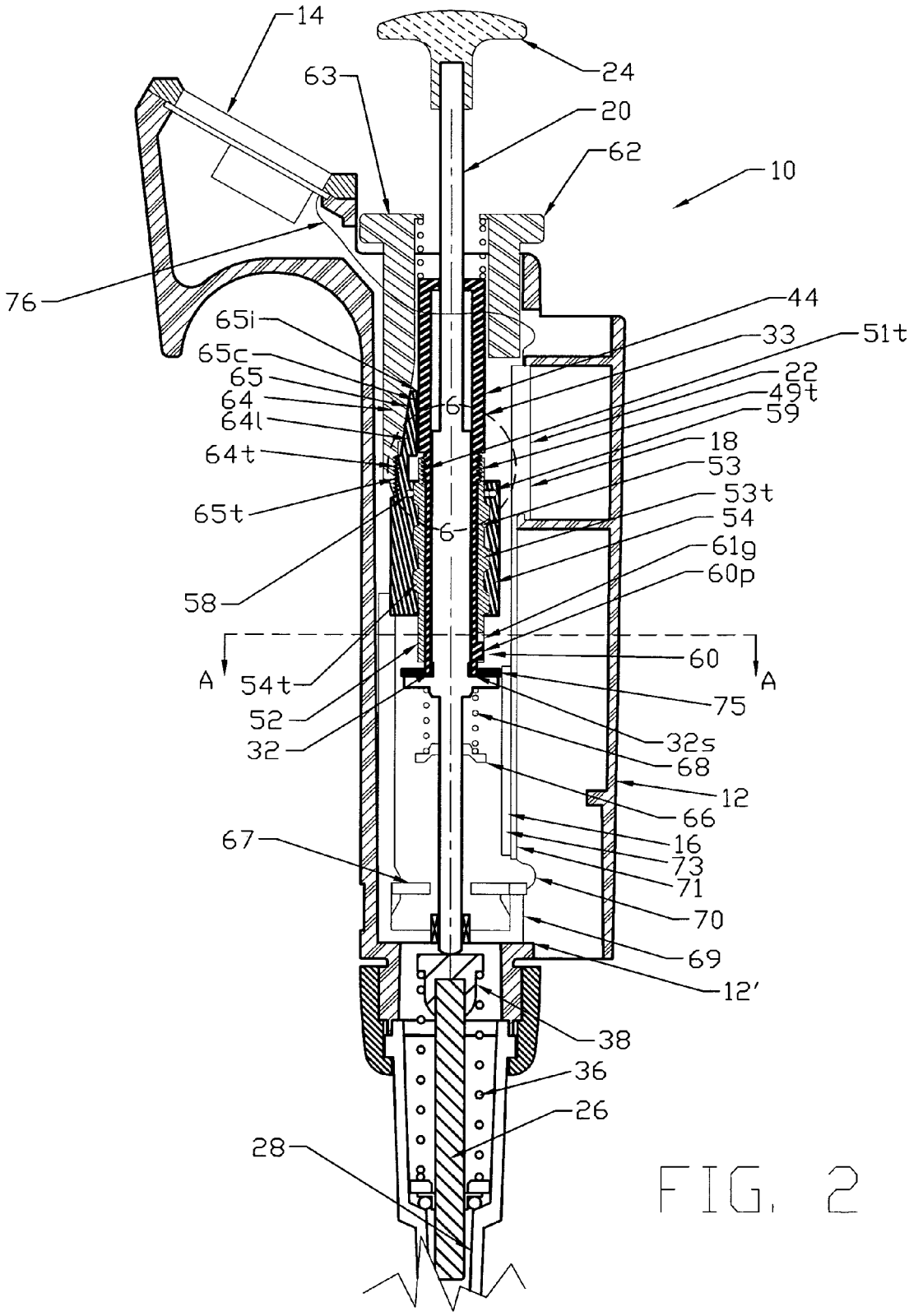
FIG. 2 is an enlarged fragmentary sectional side view of an upper portion of the volume adjustable manual pipette of FIG. 1 in a "100% volume" position.
Figure 3:
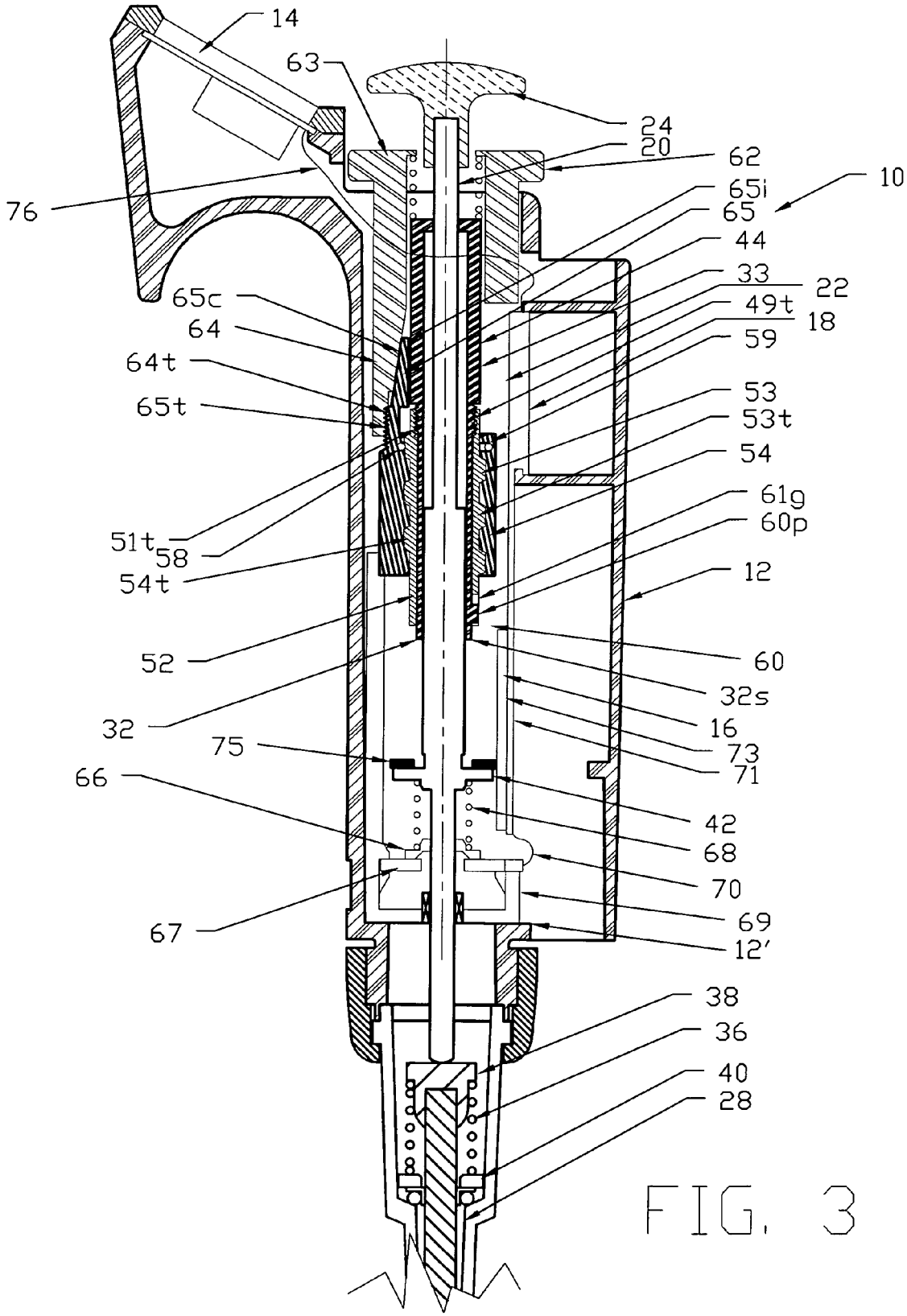
FIG. 3 is an enlarged fragmentary sectional side view similar to FIG. 2 only with the volume adjustable manual pipette in a "home" position.
Figure 4:
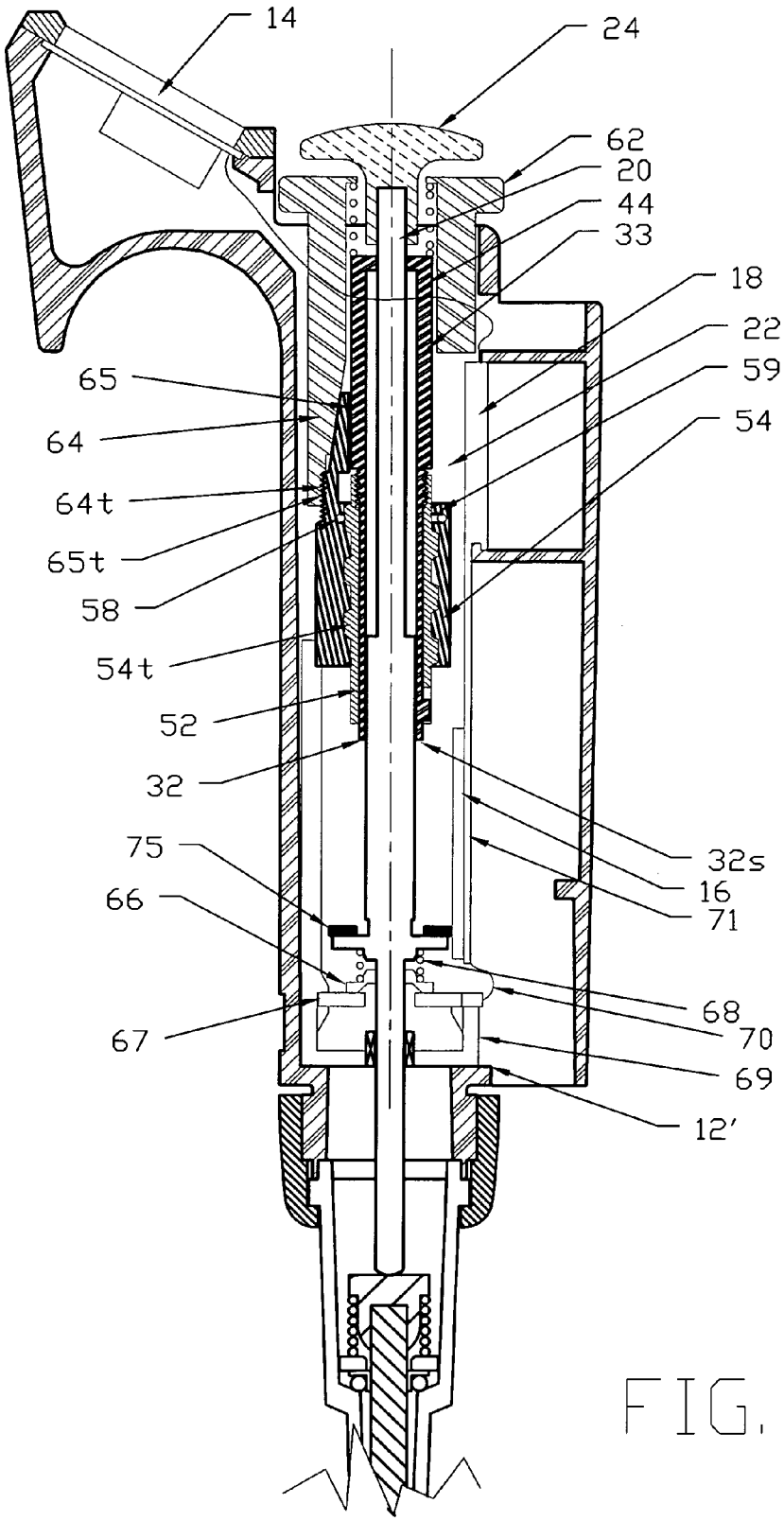
FIG. 4 is an enlarged fragmentary sectional side view similar to FIG. 2 only with the volume adjustable manual pipette in a "blow out" position.

FIGS. 2–4 depict the previously volume-set pipette 10 in various positions during operation of the pipette. Specifically, FIG. 3 depicts the pipette 10 in its "home position". The home position for the pipette 10 is its starting position for aspiration of a pre-selected volume of a sample fluid into the pipette tip 30 secured to the pipette with movement of the plunger unit 20 from the home position of FIG. 3 to the "100% volume" position of FIG. 2. The home position is defined by a home position contact 66 engaging a home switch 67. As shown in FIG. 3, the contact 66 is carried by a blow out spring 68 extending downward from the flange 42 while the home switch 67 is supported by a retainer 69 located on an inwardly extending bottom portion 12' of the housing 12. As the plunger unit 20 moves downward within the housing 12, as in response to the pipette user pushing down on the control knob 24 against the upward spring force of the return spring 36, the home position contact 66 engages the home position switch 67. The switch 67 is electrically connected by a lead 70 to a printed circuit board 71 in the control circuitry 18 depicted in FIGS. 1–4 and 8. Such engagement of the contact 66 and switch 67 produces a signal within the control circuitry 18 indicative of the pipette being at its home position.

FIG. 4 depicts the pipette 10 in a "blow out" position after the dispensing of the pre-selected volume of sample fluid from the pipette tip 30. Comparing FIGS. 3 and 4, it should be appreciated that the blow out position for the pipette 10 is reached by the plunger unit 20 passing through the home position to the blow out position where the flange 42 bottoms on a top of the home position contact 66 with the blow out spring 68 fully compressed there between.

FIG. 2 depicts the pipette 10 in a "100% volume" condition with plunger unit 20 in its uppermost position defined by the flange member 42 pressing upward on the stop surface 32*s* of the volume setting member 32 under the influence of the return spring 36. This corresponds to the operating position of the pipette following aspiration of the preset volume of sample fluid into the pipette tip 30 as determined by the volume setting for the pipette. It should be appreciated from FIG. 2 and the previous description of the volume setting for the pipette 10 that stop surface 32*s* moves vertically with the volume setting member 32 with such volume setting for the pipette 10. Also, under the influence of the return spring 36 the flange 42 is continuously urged against the stop surface 32*s* during such volume setting for the pipette 10. In fact, the flange moves up and down with the stop surface 32*s* during such volume setting procedures. Accordingly, the plunger unit 20 follows any vertical adjustment of the volume setting member 32 within the housing during any setting of the volume for the pipette 10. Such vertical movement of the volume setting member 32 and the plunger unit 20 is monitored by the sensor circuitry 16 which generates an electrical signal processed within the control circuitry 18 and visually displayed as a digital volume setting for the pipette on the display 14. Such a display rapidly depicts any changes in the volume setting for the pipette 10 and is a real time monitor of the value of such volume settings.

Figure 8:
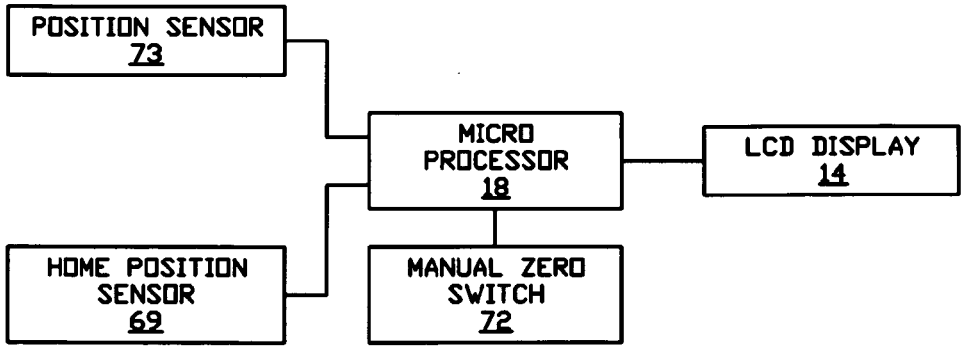
FIG. 8 is a block diagram of a typical electronic circuit including an electronic display and associated sensor and control circuitry as depicted in FIG. 1, all in accordance with the present invention.

More particularly, the display, sensor and control circuitry are depicted in the block diagram of FIG. 8, while the structure supporting such circuitry is shown in FIGS. 1–4. As shown in FIG. 8, the electronic digital display 14 may comprise a conventional LCD display controlled by a conventional microprocessor comprising the control circuitry 18. As illustrated, the electrical inputs to the micro-processor 18 may comprise a manual zero setting switch 72 located on top of the housing 12, and sensors comprising a position sensor 73 and a home position sensor 74.

The position sensor 73 is a continuous sensing device with a sensor target 75 carried by the flange member 42 or otherwise attached to the plunger unit 20. In this regard, the sensor 16 is of a type that will sense the location of the particular type of sensor target 75. For example, if the sensor target 75 is a magnet, the sensor is of a type that will respond to the magnetic field generated by the magnet to produce an electrical signal indicative of the location of the magnet relative to the sensor. Such a position signal is transmitted to the micro-processor 18 for processing and control of the electrical input to the display 14 for controlling the number value digitally displayed thereby. This provides a continuous real time read out of the volumes of liquid in the pipette tip during aspiration and dispensing and other modes of operation of the pipette 10. Also, when the flange 42 is against the stop 32*s* of the volume setting member 32 as during volume setting for the pipette in the manners previously described or when the pipette 10 is in its 100% volume position as depicted in FIG. 2, the real time value digitally shown by the display 14 is the volume setting for the pipette 10.

Referring to FIGS. 3 and 8 for the home position sensor 74, the home position is sensed when the plunger unit 20 is in a home position defined by home position contact 66 engaging the home position switch 67 as previously described relative to FIG. 3. As shown in FIG. 3, the contact 66 is carried by the blow out spring 68 extending downward from the flange 42 while the home switch 67 is supported by the retainer 69 located on an inwardly extending bottom portion 12' of the housing 12. As the plunger unit 20 moves downward within the housing 12, as in response to the pipette user pushing down on the control knob 24 against the upward spring force of the return spring 36, the home position contact 66 engages the home position switch 67. The switch 67 is electrically connected by the lead 70 to the printed circuit board 71 in the control circuitry 18 depicted in FIGS. 1–4 and 8. Upon such engagement of the contact 66 and switch 67, a signal is generated within the microprocessor comprising the control circuitry 18 and applied by a lead 76 to the display 14 to produce a display indicative of the pipette being at its home position. For example, the microprocessor may be programmed such that when the home position is sensed, an electrical signal is generated which "zero's" the display 14. Movement of the plunger unit 20 above and below the home position are then indicated by positive and negative values digitally displayed by the display 14.

The manual zero setting switch 72 is a conventional switch electrically connected as by a ribbon cable (not shown) to the micro-processor such that manual actuation of the switch by the pipette user will "zero" the digital volume displayed by the display 14. This feature is useful when a pipette user wishes to aspirate more that one liquid into the pipette tip 30 or in a multidispense mode of operation for the pipette to dispense the contents of a full tip into multiple aliquots.

For example, to dilute one sample with a diluent, a user would first set the maximum pickup volume for the pipette 10 to the sum of all the fluids to be picked up. The user would then insert the tip 30 into the diluent and carefully release the plunger button 24 until the volume readout indicated by the display 14 indicates the desired volume for the diluent. At that point, the user would remove the tip from the diluent reservoir and press the manual zero switch 66 to "zero" the volume display. Then while holding the tip in air, the user would release the plunger allowing the desired air gap volume to be drawn into the tip to separate the diluent from the sample liquid. Finally, the user would again "zero" the display and aspirate the desired sample volume of liquid into the tip.

In the multidispense mode of operation for the pipette 10, the pipette user would press the zero switch at the beginning of each aliquot and the display would read the dispensed volume relative to the zero point as a negative volume number.

Turning now to a second embodiment of the present invention as depicted in FIGS. 9–14. The second embodiment resembles the previously described embodiment with respect to the basic structure of the pipette 10, but differs therefrom by the inclusion of a planetary gear mechanism 22' as the quick set mechanism for the pipette represented as 10'. Corresponding elements of the pipette 10' will be designated by the same numerals as in the pipette 10 and will not be described in detail again with respect to the pipette 10'.

Basically, the pipette 10' comprises a digitally adjustable manual air-displacement pipette having an axially elongated hand-holdable housing 12 supporting (i) an electronic digital display 14 and associated position sensing circuitry 16 and control circuitry 18, (ii) a plunger unit 20 and (iii) a quick set volume adjustment mechanism 22' for simultaneously controlling the volume setting of the pipette and the electronic display.

The plunger unit 20 is upwardly spring biased and supported for axial movement within the housing 12 with an upper end supporting a control knob 24 above a top of the housing. The housing is shaped for hand gripping by a pipette user with his or her thumb free to depress the control knob 24 and move a lower end of the plunger unit carrying a piston 26 downwardly into a cylinder 28 to dispense liquid from a pipette tip 30 secured to the hollow shaft 31 extending from the lower end of the housing.

Basically, the quick set volume adjustment mechanism 22' comprises a volume setting member 32' for limiting upward axial movement of the plunger unit 20 in the housing 12 to define the volume setting for the pipette 10'. In the present invention, the volume setting member 32' preferably is supported for axial movement in the housing 12 only in response to a user turning of a volume adjusting member 33'.

In this regard, a turning of the volume adjusting member 33' activates operation of either a coarse volume setting means 34' or a fine volume setting means 35'. The coarse volume settings means 34' is supported in the housing 12 such that when activated, a relatively small turning of the volume adjusting member 33' produces a relatively large axial movement (i.e. coarse adjustment) of the volume setting member 32'. Similarly, the fine volume setting means 35' is supported within the housing 12 such that when activated, a relatively large turning of the volume adjusting member 33' produces a relatively small axial movement (i.e. fine adjustment) of the volume setting member 32'. Thus, by sequentially activating the course and fine volume setting means 34' and 35' through a sequential turning of the volume adjusting member 33', a user of the pipette 10' is able to quickly and accurately set and reset the volume setting of the pipette 10' simply by turning the volume adjusting member 33'.

More particularly as to the pipette 10' illustrated in FIGS. 9–11 and 14, the plunger unit 20 of the pipette is upwardly spring biased by the return spring 36 compressed between the piston return 38 and the bottom spring retainer 40. The upward bias provided by the return spring 36 causes the plunger unit 20 to move upwardly within the housing 12 until the flange member 42 fixed to the plunger engages the bottom or stop surface 32*s'* of the volume setting member 32'. In these regards, and as illustrated for example in FIG. 9, the volume setting member 32' of the pipette 10' comprises the lower end of an axially extending tubular screw 52' having a coarse external thread 53*t* on a mid-portion 53 thereof and a cylindrical axial bore 52*b* receiving the hex-shaped mid-portion 48 of the plunger 20. The coarse external thread 53*t* mates with a fixed follower arm 80 secured to the retainer 69 and extending laterally inward from the housing 12. Thus configured, a turning of the control knob 24 will not directly produce a turning of the tubular screw 52'. However, a turning of the tubular screw 52' will cause the screw 52' to move axially within the housing on the follower arm 80 to adjust the vertical position of the stop surface 32*s'* and the volume setting for the pipette 10'. As previously indicated, such turning of the screw 52' is in response to a turning of the volume adjusting member 33' which in the pipette 10' comprises the sleeve 44' having a hex-shaped inner surface mating with the hex-shaped outer surface of the mid-portion 48 of the plunger 20. Thus configured, a turning of the sleeve 44', as by a turning of the control knob 24 and plunger 20, will activate either the coarse volume setting means 34' or the fine volume setting means 35' to produce the axial adjustment of the position of the stop surface 32*s'* of the volume setting member 32' and hence an adjustment of the volume setting for the pipette 10'.

In the quick set volume adjustment mechanism 22' included in the pipette 10', the coarse and fine volume setting means 34' and 35' are embodied in a planetary gear mechanism. That mechanism includes a horizontally extending sun gear 81 carried by a lower end portion of the sleeve 44' and a horizontally extending planetary gear carrier 82 secured to a top of the screw 52' to support a plurality of circumferentially spaced planet gears 83. Each planet gear mates with the sun gear 81 and a horizontally extending ring gear 84 captured within a vertically narrow cylindrical gear housing 85 secured to the sleeve 44'.

A vertical slot 86 (see FIG. 12) in the housing 85 receives a vertically extending friction strip 87 secured to the housing 12 and engaging a radial outermost surface of the ring gear 84. This defines a force threshold for the coarse volume setting means 34' in the pipette 10' which is overcome by a predetermine turning of the fine volume setting means 35'. In this regard, the fine volume setting means 35' comprises the sun gear 81 and planetary gears 83 riding over the stationary ring gear 84 while the coarse volume setting means 34' comprises the described planetary gear mechanism after the force threshold has been exceeded by operation of the fine volume setting means 35'.

Specifically, when the force threshold defined by the friction strip 87 has not been overcome, a turning of the volume adjusting member 33', as by a turning of the control knob 24 and plunger 20, will produce a corresponding turning of sun gear 81 and a turning of the planetary gears 83 on the stationary ring gear 84. Since the planetary gears 83 are supported by the carrier 82 secured to the screw 52', the screw 52' will turn relatively slowly as the planetary gears travel along the stationary ring gear 84. This, in turn, will produce a relatively small vertical movement of the volume setting member 32' and fine adjustment of the volume setting for the pipette 10' as the coarse thread 53*t* rides on the stationary follower arm 80.

When the force threshold defined by the friction strip 87 has been overcome, a turning of the volume adjusting member 33' will produce a corresponding and relatively fast turning of the sun gear 81, planetary gear carrier 82 and ring gear 84, the planetary gears 83 being in a non-rotational state between the sun gear and ring gear. Such combined gear turning within the planetary gear mechanism will produce a relatively large vertical movement of the volume setting member 32' and coarse adjustment of the volume setting for the pipette 10' as the coarse thread 53*t* rides on the stationary follower arm 80.

In the pipette 10' the means for overcoming the force threshold associated with the friction strip 87 and the coarse volume setting means 34', comprises means responsive to a predetermined turning of the fine volume setting means 35' with a turning of the volume adjusting member 33'. Specifically in the embodiment of the present invention shown in FIGS. 9–11 and 14, the means for overcoming the force threshold of the coarse volume setting means 34' with a turning of the volume adjusting member 33' comprises a fine volume adjustment limiter 60' on a one of the volume adjusting member 33' or gear housing 85 and a shoulder 61' on another of the volume adjusting member 33' or gear housing 85. In FIGS. 9–12, the fine volume adjustment limiter 60' is shown as comprising a pin 60*p'* extending upward from a horizontal plate 88 extending radially outward from the sleeve 44' of the volume adjusting member 33' just above the planet gears 83. The pin 60*p'* rides in an arc-shaped groove 61*g'* in a horizontal top 89 of the gear housing 85 with opposite ends of the groove defining the shoulders 61 and 61'. If, for example, the pin 60*p* is in the initial rotational position "3" in FIGS. 12 and 13C against the shoulder 61, upon an initial turning of the volume adjusting member 33' in a counterclockwise direction to the position "4" in FIGS. 12 and 13D, as by a turning of the control knob 24, the member 33' will overcome the force threshold defined by the friction strip 87. When this occurs, the gear housing 85, ring gear 84, screw 52', planet gears 83 and sun gear 81 will turn together with the member 33' in a counterclockwise direction to the rotational position indicated in FIG. 13D. With such movement, the course thread 53*t* rides on the stationary course follower arm 80 to effect a coarse adjustment of the vertical position of the volume setting member 32' and its stop surface 32*s'* within the housing 12. This also effects a course volume setting for the pipette 10 as depicted by the upward movement of the screw 52' relative to the follower arm 80 in FIG. 14. If the pipette user then desires to more finely adjust the volume setting for the pipette 10', he or she may simply turn the volume adjusting member 33' in a clockwise direction as by a clockwise turning of the control knob 24. Such clockwise movement of the volume adjusting member 33' will move the pin 60*p*' away from the shoulder 61 and will produce a corresponding clockwise turning of the sun gear 81, as to the position "2" in FIG. 13B. As this occurs, the planet gears 83 will turn on the stationary ring gear 84 producing a turning of the screw 52' effecting a fine vertical adjustment of the volume setting member 32' and surface 32*s*' within the housing 12 and a fine volume setting for the pipette 10'.

Figure 12:
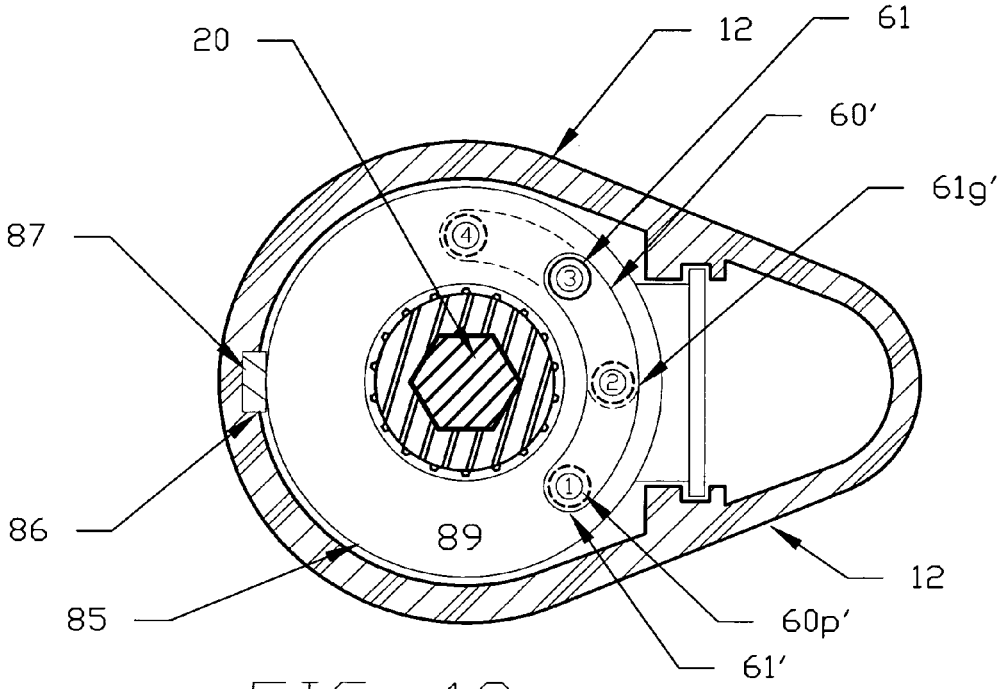
FIG. 12 is an enlarged sectional top view of a portion of quick set mechanism shown in FIG. 9 looking in the direction B—B and showing the volume adjusting member in different rotational positions.
Figure 13A:
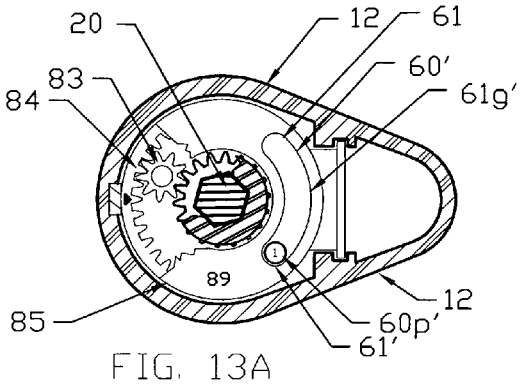
FIG. 13A, 13B, 13C and 13D are enlarged sectional top views of the portion of quick set mechanism shown in FIG. 12 with a portion of a ring gear cover removed to show different rotational positions of a planet gear between a sun gear and a ring gear of the planetary gear box of FIG. 9 for each of the rotational positions depicted in FIG. 12, FIG. 13D illustrating the rotational movement of ring gear during coarse adjustment of the volume setting member.
Figure 13C:
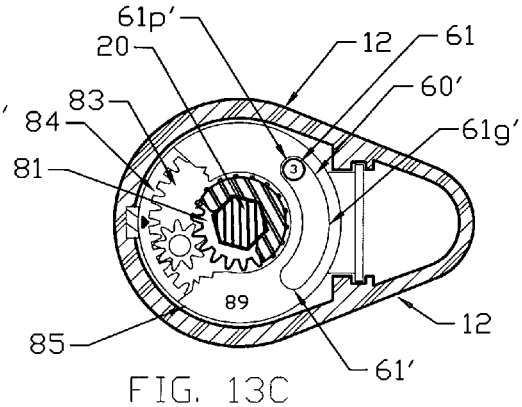
Figure 13B:
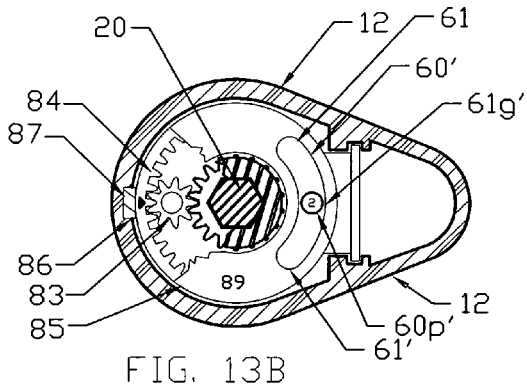
Figure 13D:
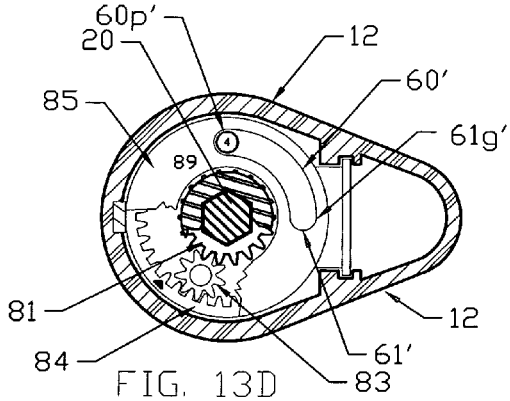
Figure 14:
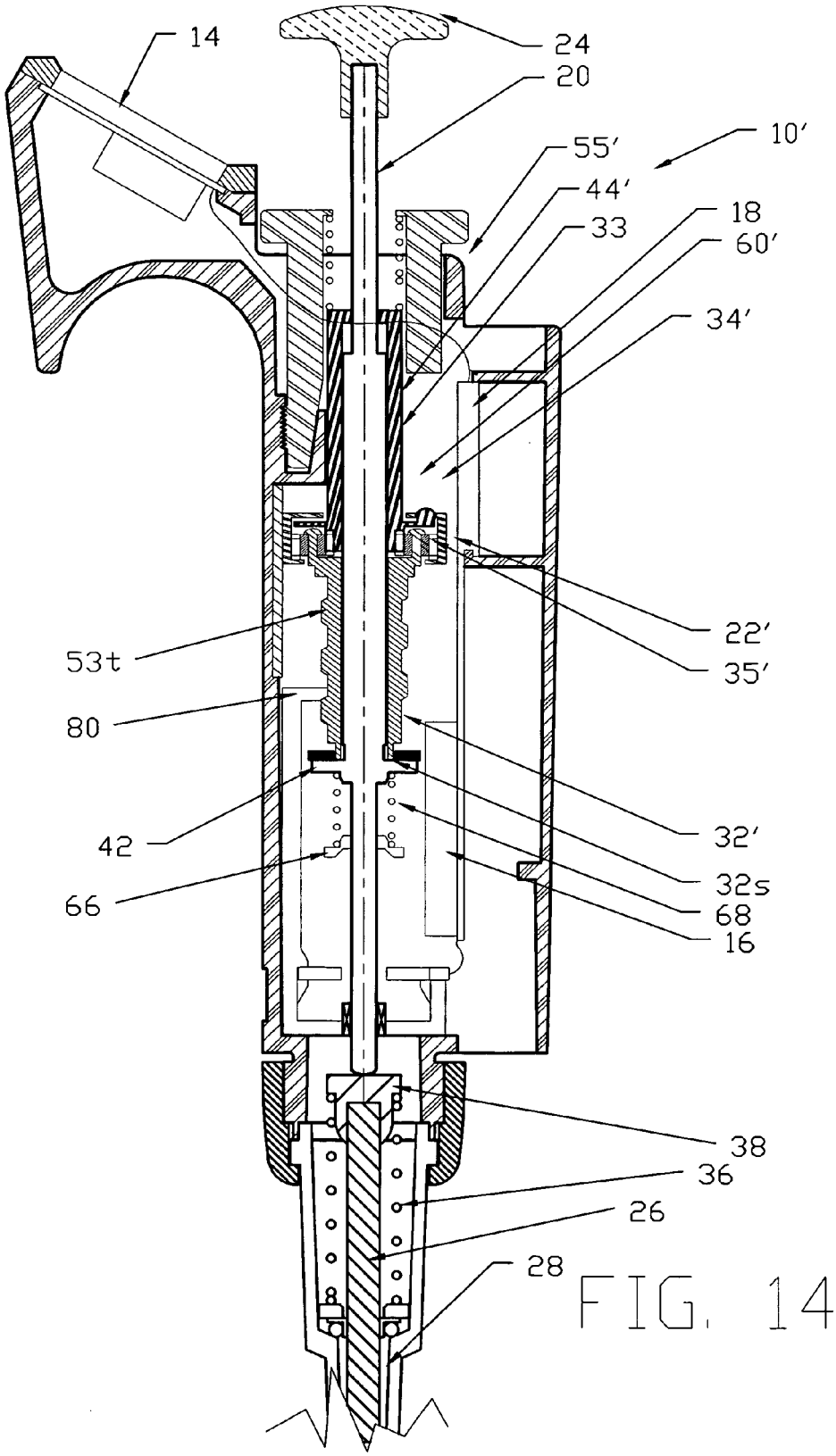
FIG. 14 is an enlarged vertical sectional side view of a portion of the quick set mechanism illustrating the vertical movement of the volume setting member during coarse adjustment of the volume setting member with rotational movement of the volume adjusting member between the positions shown in FIG. 13C and FIG. 13D.

If, however, the pin 60*p*' is in the initial rotational position "1" in FIG. 12 and 13A against the shoulder 61', upon an initial turning of the volume adjusting member 33' in a clockwise direction, for example to a position opposite that indicated as "4" in FIGS. 12 and 13D, the member 33' will also overcome the force threshold defined by the friction strip 87. When this occurs, the gear housing 85, ring gear 84, screw 52', planet gears 83 and sun gear 81 will turn together with the member 33' in a clockwise direction. With such movement, the course thread 53*t* rides on the stationary follower arm 80 to effect a coarse adjustment of the vertical position of the volume setting member 32' and its stop surface 32*s*' within the housing 12. This also effects a course volume setting for the pipette 10' with downward movement of the screw 52' relative to the follower arm 80. If the pipette user then desires to more finely adjust the volume setting for the pipette 10', he or she may simply turn the volume adjusting member 33' in a counterclockwise direction as by a counterclockwise turning of the control knob 24. Such counterclockwise movement of the volume adjusting member 33' will move the pin 60*p*' away from the shoulder 61' and will produce a corresponding counterclockwise turning of the sun gear 81 as to the position "2" in FIG. 13B. As this occurs, the planet gears 83 will turn on the stationary ring gear 84 producing a turning of the screw 52' effecting a fine vertical adjustment of the volume setting member 32' and stop surface 32*s*' within the housing 12 and a fine volume setting for the pipette 10'.

Of course, if the pin 60*p*' is in an initial position corresponding to position "1" or position "3" in FIG. 12, or any position in between, e.g. position "2", and only a fine adjustment of the volume setting of the pipette 10' is desired, the user may turn the volume adjusting member 33' in the appropriate counterclockwise or clockwise directions, as by a turning of the control knob 24. As this occurs, the sun gear 81 will turn in the same direction effecting a turning of the planet gears 83 on the stationary ring gear 84 to effect the desired fine adjustment of the volume setting member 32' and its stop surface 32*s*' (compare the rotational positions of the planet gear 83 in FIGS. 13A, B and C). However, if the pin 60*p*' is in an initial position between position "1" and "3" as depicted in FIG. 12, e.g. position "2", and the user desires to effect a large change in the volume setting for the pipette 10', the pin 60*p*' first must be turned by the volume adjusting member 33' to position "1" or position "3" depending upon whether the volume setting is to be increased or decreased. During such turning of the pin 60*p*' the fine volume setting means 35' is activated. Once the pin 60*p*' reaches position "1" or "3", a continued turning of the volume adjusting member 33' and pin 60*p*' in the same direction will deactivate the fine volume setting means 35' and will activate the coarse volume setting means 34' as previously described. Continued turning of the volume adjusting member 33' will produce a rapid coarse adjustment of the volume setting member 32' to the desired new volume setting or slightly beyond, whereupon the user will deactivate the coarse volume setting means 34' and activate the fine volume setting means 35' by reversing the direction of turning of the volume adjusting member 33'. With activation of the fine volume setting means 35', the user will continue turning the volume adjusting member 33' to produce a fine adjustment of the volume setting member 32' to the new desired volume setting for the pipette 10'.

In any event, once the desired volume setting of the pipette 10' has been achieved by a turning of the volume adjusting member 33' as described above, the user may set the desired volume setting for the pipette 10'. This is accomplished by the user activating the volume lock 55' to secure the volume adjusting member 33' relative to the housing 12. In this regard, the volume lock 55' illustrated in FIGS. 9–11 and 14 may comprise the lock knob 62' extending upwardly through the open end 56 of the housing 12. The lock knob 62' is supported such that an enlarged annular upper end 63 of the lock knob is located above a top of the housing 12 just below the control knob 24. The upper end 63 is designed for finger gripping by a pipette user when it desired to turn the lock knob 62' and release or activate the lock 55'. In this regard, a plurality of circumferentially spaced arc-shaped vertical prongs 64' extend downward from the lock knob 62' each with an external thread 64*t*' engaging an internal thread 65*t*' on an arc-shaped vertical inner sidewall 65*w* of the housing 12. For increased clarity, only one of the plurality of prongs 64' is shown in each of FIGS. 9–11 and 14. As illustrated, each prong 64' includes a downwardly and outwardly inclined cam surface 64*c* mating with an upwardly and inwardly inclined cam surface 65*c* on a prong 65' extending from the inner wall of the housing 12. Also, an inner surface 65*i*' of each prong 65' closely follows the cylindrical exterior of the radially enlarged portion of the sleeve 44' comprising the volume adjusting member 33'. Thus constructed, when a pipette user desires to lock the volume setting for the pipette 10', the user simply grasps and turns the lock knob 62' in a first direction such that cooperative action of the threads 64*t*' and 65*t*' and cam surfaces 64*c* and 65*c* wedge the inner surfaces 65*i*' against the sleeve 44' locking the volume adjusting member 33' against turning within the housing 12. When a pipette user desires to release the lock 55' and adjust the volume setting for the pipette, the user simply grasps and turns the lock knob 62' in an opposite direction. Cooperative action of the threads 64*t*' and 65*t*' then separates the cam surfaces 64*c* and 65*c* and releases the inner surfaces 65*i*' from the sleeve 44' thereby freeing the volume adjusting member 33' for turning in the housing to quickly and accurately adjust the volume setting for the pipette in the manners previously described. Once the desired new volume setting has been achieved, the lock 55' is again activated as previously described readying the pipette 10' for operation in aspirating and dispensing sample fluids.

Figure 9:
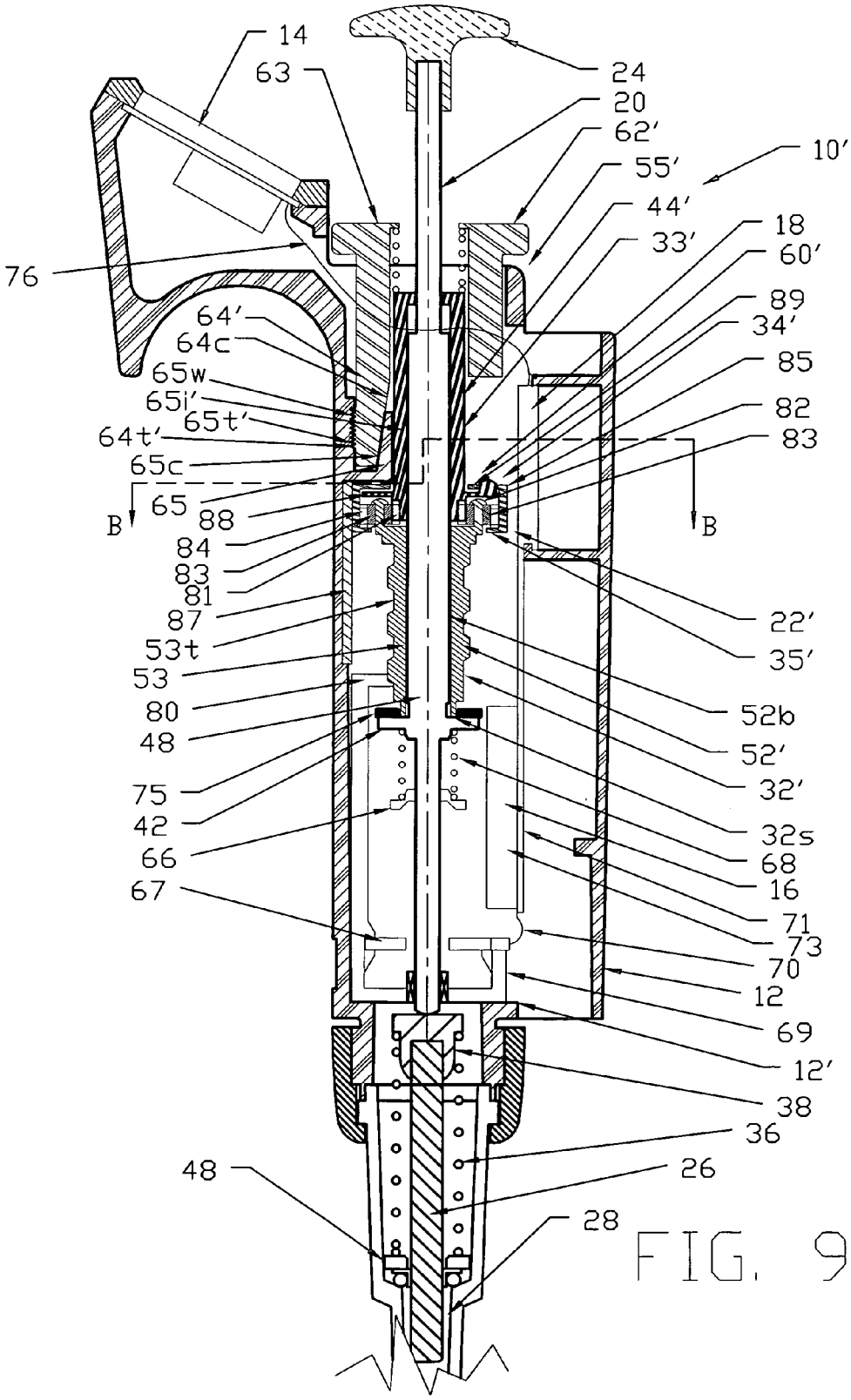
FIG. 9 is a fragmentary sectional side view of an upper portion of a volume adjustable manual pipette in a "100% volume" position and having an axially elongated hand-holdable housing supporting an electronic digital display and associated position sensing and control circuitry, a plunger unit and a second or planetary gear box embodiment of a quick set volume adjustment mechanism according to the present invention.
Figure 10:
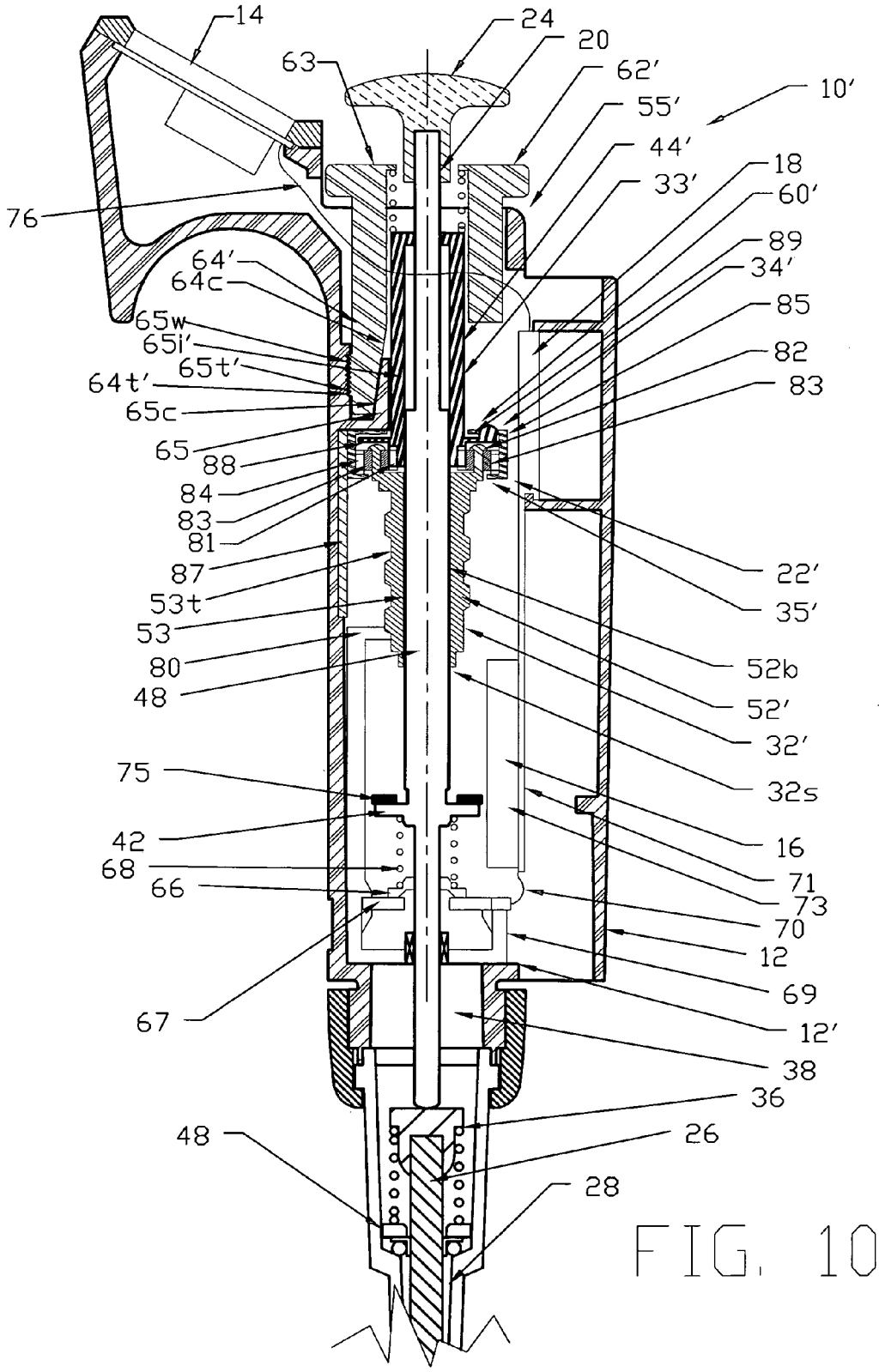
FIG. 10 is a fragmentary sectional side view of the volume adjustable manual pipette of FIG. 9 in a "home" position.
Figure 11:
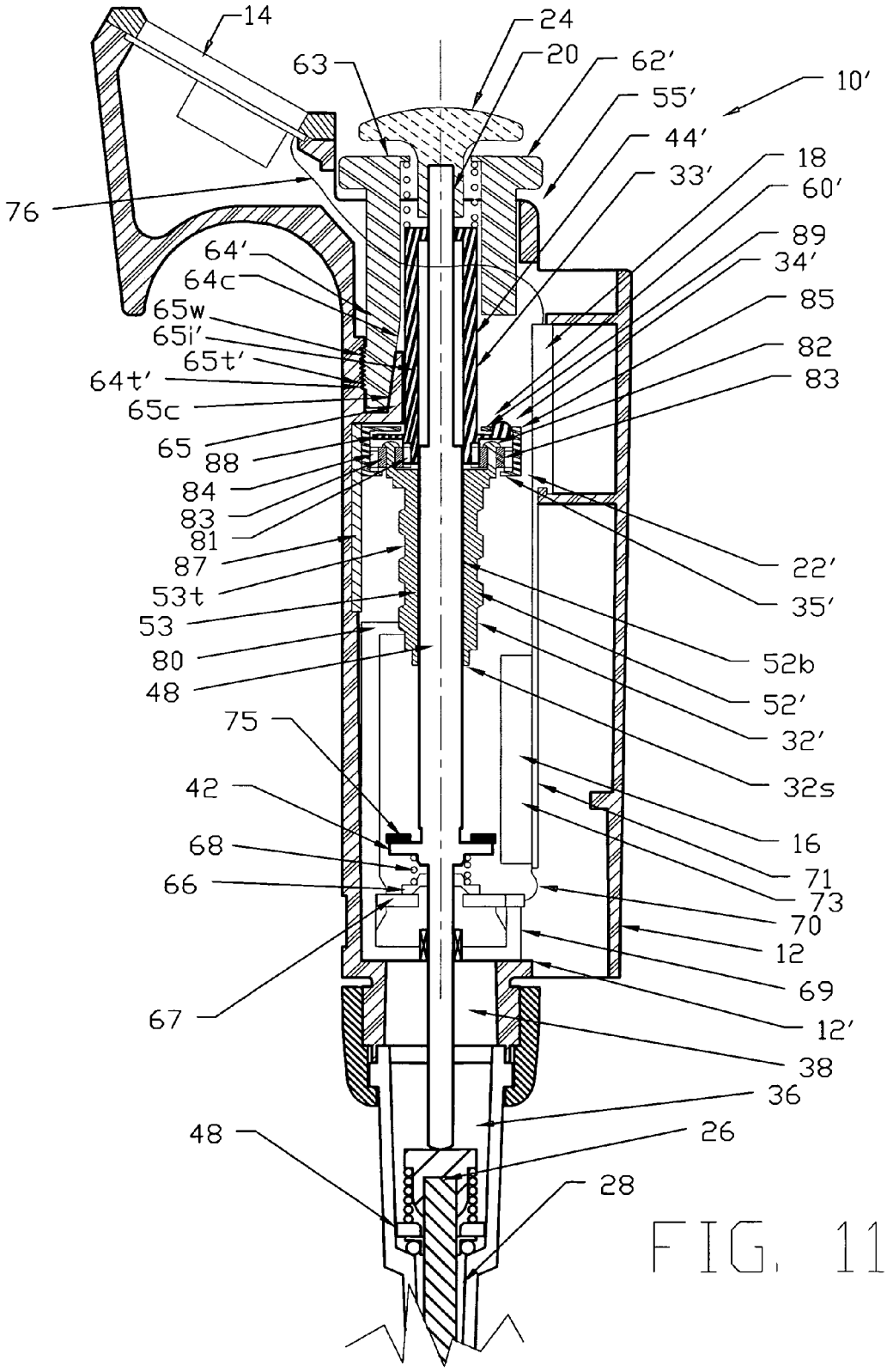
FIG. 11 is a fragmentary sectional side view of the volume adjustable manual pipette of FIG. 9 in a "blow out" position.

FIGS. 9–11 depict the previously volume-set pipette 10' in various positions during operation of the pipette. Specifically, FIG. 10 depicts the pipette 10' in its "home position". The home position for the pipette 10' is its starting position for aspiration of a pre-selected volume of a sample fluid into a pipette tip secured to the pipette with movement of the plunger unit 20 from the home position of FIG. 10 to the "100% volume" position of FIG. 9. The home position is defined by the home position contact 66 engaging the home switch 67. As shown in FIG. 10, the contact 66 is carried by the blow out spring 68 extending downward from the flange 42 while the home switch 67 is supported by the retainer 69 located on the inwardly extending bottom portion 12' of the housing 12. As the plunger unit 20 moves downward within the housing 12, as in response to the pipette user pushing down on the control knob 24 against the upward spring force of the return spring 36, the home position contact 66 engages the home position switch 67. The switch 67 is electrically connected by the lead 70 to a printed circuit board 71 in the control circuitry 18 depicted in FIGS. 9–11 and 8. Such engagement of the contact 66 and switch 67 produces a signal within the control circuitry 18 indicative of the pipette being at its home position.

FIG. 11 depicts the pipette 10' in a "blow out" position after the dispensing of the pre-selected volume of sample fluid from the pipette tip. Comparing FIGS. 10 and 11, it should be appreciated that the blow out position for the pipette 10' is reached by the plunger unit 20 passing through the home position to the blow out position where the flange 42 bottoms on a top of the home position contact 66 with the blow out spring 68 fully compressed there between.

FIG. 9 depicts the pipette 10' in a "100% volume" condition with plunger unit 20 in its uppermost position defined by the flange member 42 pressing upward on the stop surface 32*s*' of the volume setting member 32' under the influence of the return spring 36. This corresponds to the operating position of the pipette following aspiration of the pre-selected volume of sample fluid into the pipette tip as determined by the volume setting for the pipette. It should be appreciated from FIG. 2 and the previous description of the volume setting for the pipette 10' that stop surface 32*s*' moves vertically with the volume setting member 32' with such volume setting for the pipette 10. Also, under the influence of the return spring 36 the flange 42 is continuously urged against the stop surface 32*s*' during such volume setting for the pipette 10'. In fact, the flange moves up and down with the stop surface 32*s*' during such volume setting procedures. Accordingly, the plunger unit 20 follows any vertical adjustment of the volume setting member 32' within the housing during any setting of the volume for the pipette 10'. Such vertical movement of the volume setting member 32' and the plunger unit 20 is monitored by the sensor circuitry 16 which generates an electrical signal processed within the control circuitry 18 and visually displayed as a digital volume setting for the pipette on the display 14. Such a display rapidly depicts any changes in the volume setting for the pipette 10' and is a real time monitor of the value of such volume settings.

More particularly, the display, sensor and control circuitry are as depicted in and described relative to the block diagram of FIG. 8, while the structure supporting such circuitry is shown in FIGS. 9–11.

Figure 15:
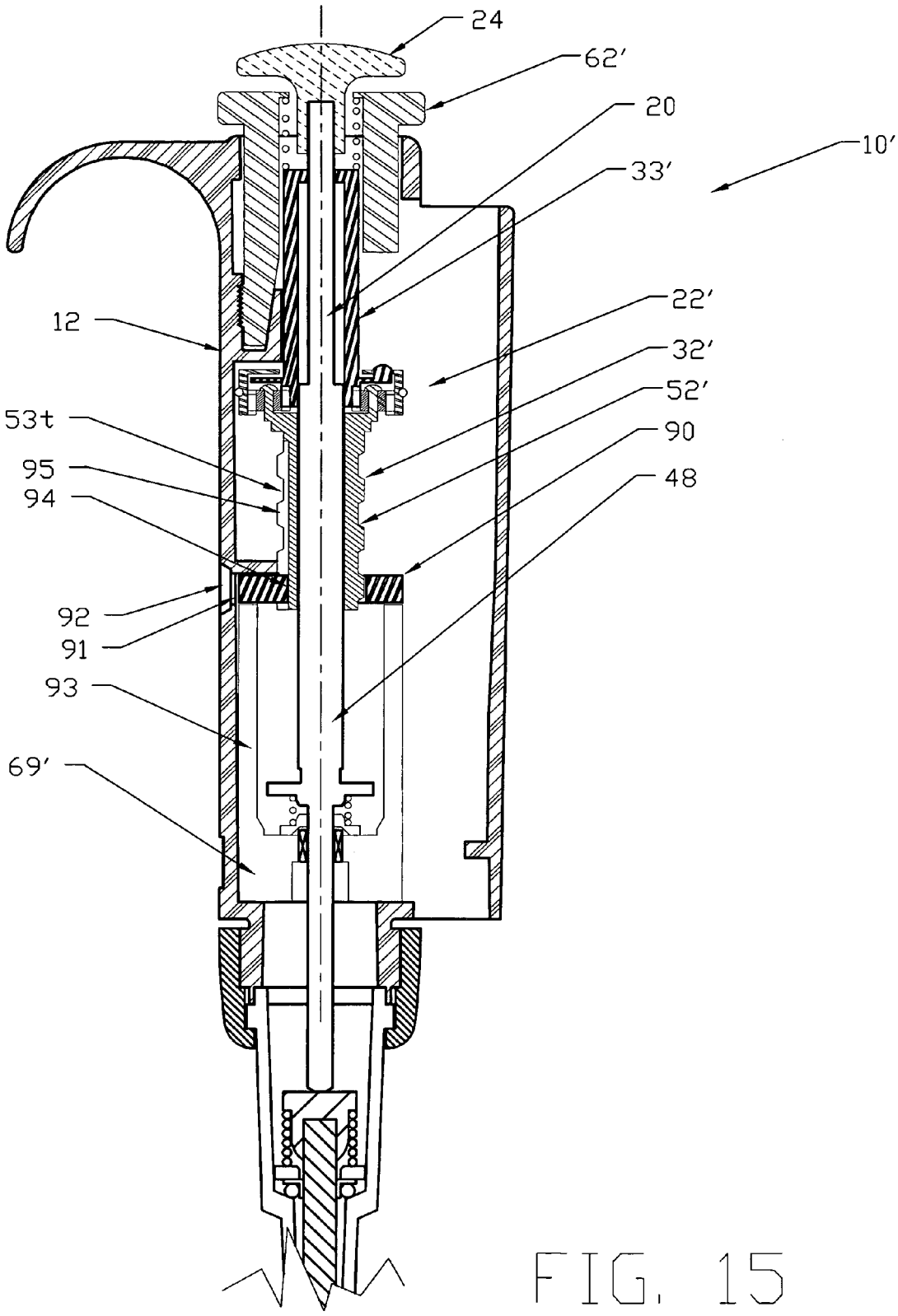
FIG. 15 is a fragmentary sectional side view of an upper portion of a volume adjustable manual pipette similar to that shown in FIG. 9 including a planetary gear box embodiment of a quick set volume adjustment mechanism according to the present invention and including a mechanical volume indicator comprising a single large counter wheel in place of the electronic display shown in FIG. 9.

In each of the two preferred embodiments of the present invention previously described, the means for monitoring and indicating the volume setting for the illustrated pipettes comprise an electronic display system. The present invention contemplates that mechanical display systems may be included in preferred embodiments of the present invention. In this regard, FIG. 15 illustrates the pipette 10' shown in FIG. 11 including an example of such a mechanical display system. Specifically, as shown, the pipette 10' of FIG. 15 includes a relatively large conventional counter wheel 90 having an number carrying outer surface 91 facing a window 92 in a side of the housing 12. The wheel 90 is supported on top of a cylindrical version of the retainer 69 indicated by the numeral 69'. Also, the wheel 90 is mounted to turn with the screw 52' comprising the volume setting member 32'. In this regard, a key 94 extends inward from an inner hub of the wheel and rides in a vertically extending keyway 95 in the screw 52'. Thus constructed, the wheel 90 will turn with the screw 52' as the volume setting for the pipette 10' is adjusted in the manners previously described in connection with FIGS. 9–11 and 14. As the wheel 90 turns, different numbers indicative of the volume setting for the pipette 10' are displayed through the window 91 for viewing by the user of the pipette.

Figure 16:
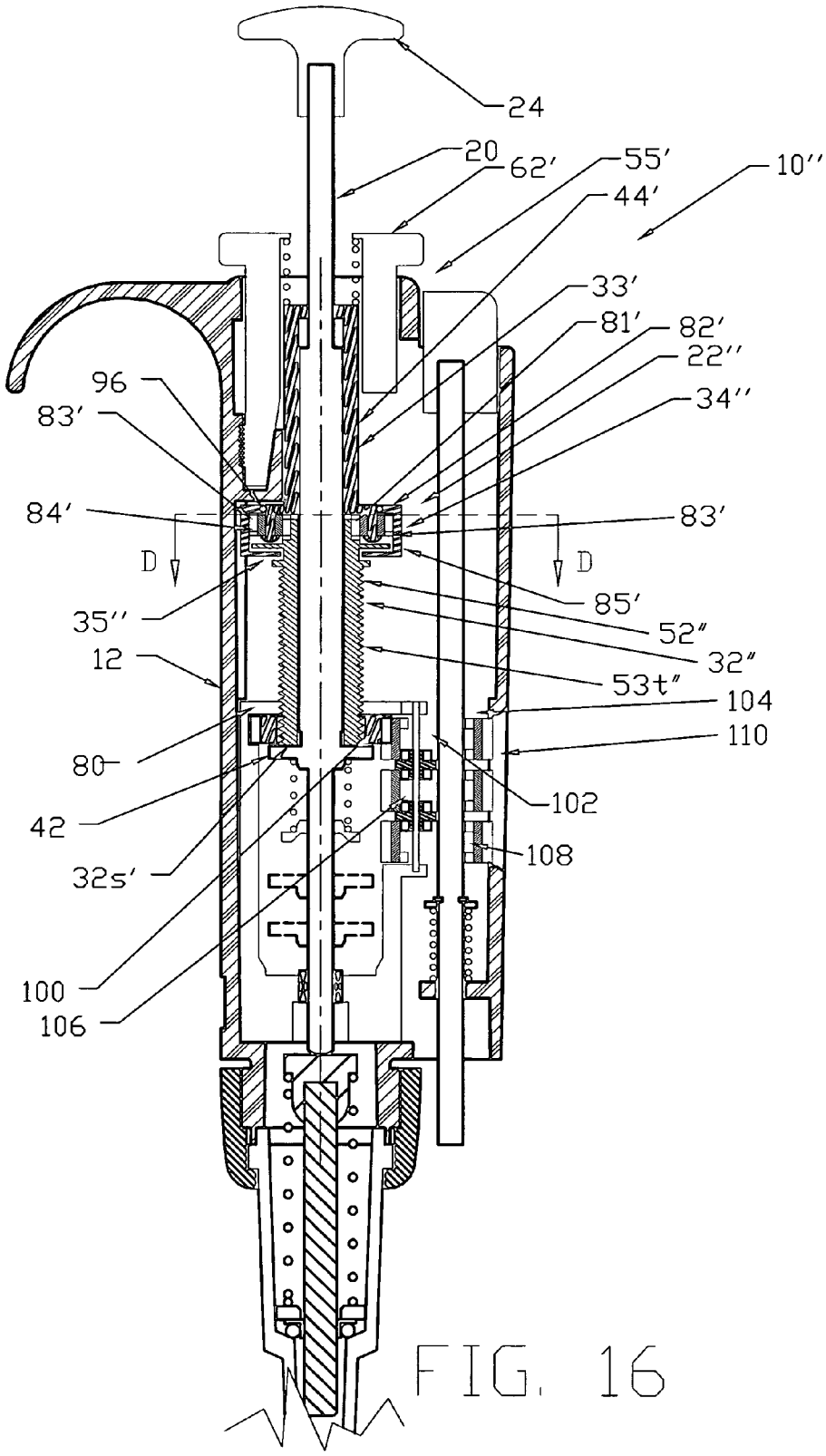
FIG. 16 is a fragmentary sectional side view of an upper portion of a volume adjustable manual pipette similar to that shown in FIG. 15 including a modified planetary gear box embodiment as the quick set volume adjustment mechanism according to the present invention and including a mechanical volume indicator comprising a series of counter wheels.

The embodiment of the present invention illustrated in FIG. 16 also includes a mechanical volume display system in a modified version of the pipette 10' indicated by the numeral 10". While the pipette 10" resembles the previously described pipette 10', it differs there from by the inclusion of an inverted version of the planetary gear mechanism 22" comprising the quick set system 22' and a modified volume setting member 32" comprising a screw 52" carrying a relatively fine external thread 53*t*".

More specifically, the inverted planetary gear mechanism comprises a planet gear carrier 82' in the form of horizontal flange extending radially outward at a lower end of the sleeve 44' comprising the volume adjusting member 33'. A plurality of circumferentially spaced planet gears 83' are carried by and extend below the carrier plate 82' to mate with a sun gear 81' secured to an upper portion of the screw 52" comprising the volume adjusting member 33'. The planet gears 83' also mate with an outer horizontally extending ring gear 84' supported by a gear housing 85'.

As shown in FIG. 16, a friction ring 96 is captured between the planet gear carrier plate 82' and the gear housing 85' to define a force threshold for the coarse volume setting means 34" which must be overcome by a predetermined turning of the volume adjusting member 33' with an operational fine volume setting means 35" before the ring gear 84' is able to turn relative to the planet gears 83'. As in the prior embodiments, that force threshold is overcome by cooperative operation of a limiter 60" and shoulders 61".

Figure 17:
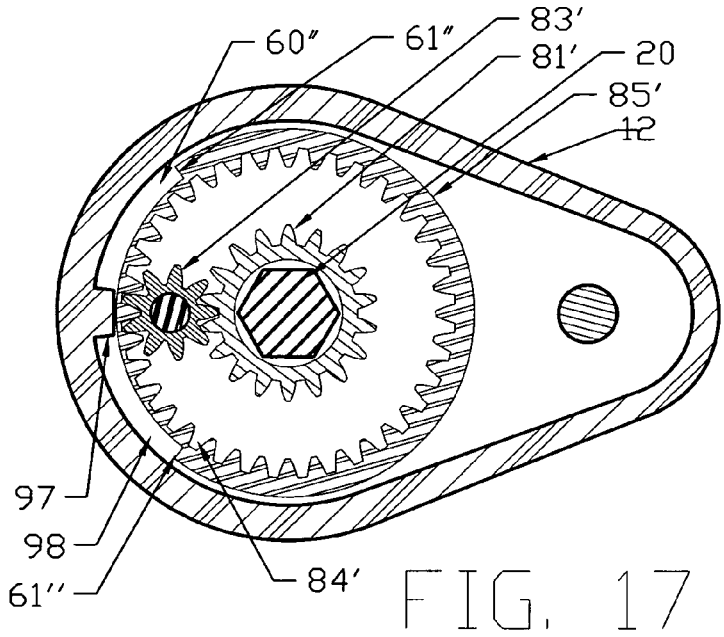
FIG. 17 is an enlarged sectional top view of the portion of quick set mechanism shown in FIG. 16 looking in the direction of the line D—D to display portions a ring gear and planet gears between a sun gear and the ring gear in the planetary gear embodiment of FIG. 16.

As shown in FIG. 17, in the pipette 10" the limiter 60" comprises an inward stop 97 extending from an inside of the housing 12 to ride in an arc-shaped groove 98 in an outer surface of the gear housing 85' fixed to the ring gear 84', opposite ends of the groove defining the shoulders 61". In operation, when the sun gear 81', planet gears 83' and ring gear 84' are in the positions indicated in FIG. 17, the fine volume setting means 35" is operational and a turning of the volume adjusting member 33', as by a turning of the control knob 24 and plunger 20, will produce a turning of planet gears 83' and ring gear 84' as a unit to produce a corresponding turning of the sun gear 81'. Since the sun gear 81' is fixed to the screw 52", the screw 52" will turn slowly in a like manner with the fine thread 53*t*" riding on the stationary follower arm 80 to finely adjust the vertical position of the stop surface 32*s*' and hence the volume setting for the pipette 10".

Such fine adjustment of the volume setting for the pipette 10" will continue until the stop 97 engages one of the shoulders 61". When that occurs, the fine volume setting means 35" will be deactivated and the course volume setting means 34" activated. This occurs as a result of the stop 97 bearing on one of the shoulders 61" with a continued turning of the volume adjusting member 33' to overcome the force threshold defined by the friction ring 96 allowing the ring gear 84' to turn relative to the planet gears 83' with continued turning of the volume adjusting member 33'. As this occurs, the turning of the ring gear 84' by the volume adjusting member 33' produces a turning of the planet gears 83' to rapidly drive the sun gear 81'. This produces a more rapid turning of the screw 52" and a corresponding more rapid vertical movement or coarse adjustment of the screw 52" as the fine thread 53*t*" rides on the stationary follower arm 80 adjust the volume setting for the pipette 10".

As with the previously described embodiments of the present invention, such coarse adjustment of the volume setting of the pipette 10" may be followed by a fine adjustment of the volume setting. This may be accomplished simply by a turning of the volume adjusting member 33' in an opposite direction. As this occurs, the stop 97 will move away from the shoulder 61" to deactivate the course volume setting means 34" and reactivate the fine volume setting means 35". With reactivation of the fine volume setting means 35", a continued turning of the volume adjusting member 33' in the opposite direction will result in the ring gear 84' and planet gears 83' turning as a unit to more slowly turn the sun gear 81' and screw 52" to produce a fine adjustment of the vertical position of the stop surface 32*s*' within the housing 12 and a fine adjustment of the volume setting for the pipette 10" in the manner previously described.

In the pipette 10" of FIG. 16, the coarse and fine adjustment of the volume setting for the pipette is visually displayed by the illustrated mechanical display system. As shown, that system comprises a horizontally extending double ring gear 100 supported by the retainer 69 with an inwardly extending gear thereof mating with vertical splines (not shown) on the outer surface of the screw 52". Thus arranged, a turning of the screw 52" during the above described adjustment of the volume setting for the pipette 10" will produce a turning of the ring gear 100 with an outwardly extending gear thereof mating with spur gear counter wheel 102 of a standard wheel mechanical counter 104 including the wheel 102 and similar wheels 106 and 108. In a conventional manner, the counter wheels are constructed and assembled such that the wheel 102 will turn with the spur gear 100. The wheel 106 will turn one unit with each revolution of the wheel 102 while the wheel 108 will turn one unit with each revolution of the wheel 106, the wheels 102, 106 and 108 providing the unit's, ten's and hundred's indications for the digital display provided to a user of the pipette 10" by the counter 104 through a window 110 in the housing 12.

While particular embodiments of the present invention have been illustrated and described in detail above, it is appreciated the changes and modifications may be made in the illustrated embodiments without departing from the spirit of the invention. Accordingly, the scope of present invention is to be limited only by the terms of the following claims.

The invention claimed is:

1. A volume adjustable pipette (10;10';10") comprising a housing (12), a plunger (20) mounted for axial movement in the housing to and from a stop (32*s*;32*s*';32*s*') during aspiration of a fluid into and dispensing of the fluid from a tip extending from the housing, an axially moveable volume setting member (32;32';32") in the housing defining the stop (32*s*; 32*s*'; 32*s*') for the plunger and a volume setting for the pipette, a turnable volume adjusting member (33;33';33') and volume adjusting means (22;22';22") for axially moving the volume setting member (32;32';32") in response to a turning of the volume adjusting member (33;33';33'), characterized by:

coarse volume setting means (34;34';34") in the volume adjusting means (22;22';22") responsive to a turning of the volume adjusting member (33;33';33') for axially moving the volume setting member (32;32';32") relatively large axial distances in response to relatively small turnings of the volume adjusting member (33; 33';33');

fine volume setting means (35;35';35") in the volume adjusting means (22;22';22") responsive to a turning of the volume adjusting member (33;33';'33') for axially moving the volume setting member (32;32';32") relatively small axial distances in response to relatively large turnings of the volume adjusting member (33;33'; 33');

one of the coarse and fine volume setting means (34,34'; 35,35';35") defining a one of the volume setting means and the other of the coarse and fine volume setting means defining an other of the volume setting means, the one of the volume setting means being characterized by a force threshold (58;87;96) for axial movement of the volume setting member (32;32';32") by the one of the volume setting means that is exceeded by a predetermined movement of the other of the volume setting means in response to a turning of the volume adjusting member (33;33';33'); and means (60,61;60',61,61';60",61") for overcoming the force threshold (58;87;96) in response to a turning of the volume adjusting member (33;33';33').

2. The pipette (10;10') of claim 1 further including means (16,75) for monitoring the position of the plunger (20) within the housing (12).

3. The pipette (10;10') of claim 1 further including means (16,75,42) for monitoring the position of the volume setting member (32) within the housing (12).

4. The pipette (10) of claim 1 wherein:

the coarse volume setting means (34) includes a relatively coarse thread (53*t*) on an axially extending screw (52) carried by the volume setting member (32); and the fine volume setting means (35) comprises a relatively fine thread (51*t*) on the screw (52) and a relatively fine thread (49*t*) on a sleeve (44) comprising the volume adjusting member (33) and which engages the relatively fine thread (51*t*) on the screw (52).

5. The pipette (10) of claim 4 further comprising:

a fine adjustment limiter (60) on a one of the volume adjusting member (33) or screw (52); and a shoulder (61) on another of the volume adjusting member (33) or screw (52) for engaging the limiter whereby a turning of the volume adjusting member (33) with the limiter against the shoulder produces a turning of the screw (52) with the volume adjusting member (33).

6. The pipette (10';10") of claim 1 further comprising:

a gear mechanism (22';22") between the volume adjusting member (33'; 33') and the volume setting member (32';32") and responsive to a turning of the volume adjusting member (33';33') to selectively produce a relatively small axial movement of the volume setting member through the fine volume setting means (35'; 35") and responsive to a turning of the volume adjusting member (33';31') to produce a relatively large axial movement of the volume setting member (32';32") through the coarse volume setting means (34';34").

7. The pipette (10') of claim 6 wherein:

the volume setting member (32') comprises an axially extending screw (52') having a relatively coarse thread (53*t*); and the gear mechanism (22') comprises a planetary gear mechanism including.

a planetary gear carrier (82) on the screw (52') comprising the volume setting member (32'), a plurality of circumferentially spaced planetary gears (83) on the carrier separately mating with an outer ring gear (84) and;

an inner sun gear (81) carried by the volume adjusting member (33') mating with the plurality of planetary gears (83) to produce a turning of the sun gear, planetary gears and volume setting member (32') in response to a turning of the volume adjusting member (33') to adjust the volume setting of the pipette.

8. The pipette (10') of claim 7 further comprising:

a gear housing (85);

a fine adjustment limiter (60') on a one of the volume adjusting member (33') or a gear housing (85); and a shoulder (61) on another of the volume adjusting member (33') or gear housing (85) for engaging the limiter whereby a turning of the volume adjustment member (33') with the limiter against the shoulder produces a turning of the ring gear (84) with the planetary gears (83) and carrier (82) to turn the volume setting member (32') thereby adjusting the volume setting for the pipette.

9. The pipette (10') of claim 8 further comprising a counter wheel (90) for turning with the volume setting member (32') to indicate the volume setting of the pipette.

10. The pipette (10") of claim 6 wherein:

the coarse volume setting means (34") includes a thread (**53*t*") on an axially extending screw (52") comprising the volume setting member (32"); and the gear mechanism (22') comprises a planetary gear mechanism including a planetary gear carrier (82') on the screw (52"), a plurality of circumferentially spaced planetary gears (83') on the carrier (82') separately mating with an outer ring gear (84') coupled to the carrier and an inner sun gear (81') carried by the volume setting member (32") mating with the plurality of planetary gears (83') to produce a turning of the sun gear, planetary gears and volume setting member in response to a turning of the volume adjusting member (33'**) to adjust the volume setting of the pipette.

11. The pipette (10") of claim 10 further comprising:

a gear housing (85'):

a fine adjustment limiter (60") on one of the housing (85') or ring gear (84'); and a shoulder (61") on another of the housing (85') or ring gear (84') for engaging the limiter (60") whereby a turning of the volume adjustment member (33') with the limiter against the shoulder produces a turning of the ring gear (84') with the planetary gears (83') and carrier (82') to turn the volume setting member (32") thereby adjusting the volume setting for the pipette.

12. The pipette (10") of claim 11 further comprising counter wheel means (100,102,104) for turning with the volume setting member (32") to indicate the volume setting of the pipette.

* * * * *